US007798589B2

(12) United States Patent
Torii

(10) Patent No.: US 7,798,589 B2
(45) Date of Patent: Sep. 21, 2010

(54) IMAGE FORMING APPARATUS, IMAGE PROCESSING APPARATUS, AND CONTROL METHOD THEREFOR

(75) Inventor: Satoru Torii, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 407 days.

(21) Appl. No.: 12/026,853

(22) Filed: Feb. 6, 2008

(65) Prior Publication Data

US 2008/0253779 A1 Oct. 16, 2008

(30) Foreign Application Priority Data

Feb. 8, 2007 (JP) ..... 2007-029713

(51) Int. Cl.
*B41J 29/38* (2006.01)
*B41J 29/393* (2006.01)

(52) U.S. Cl. ..... 347/12; 347/14; 347/15; 347/19

(58) Field of Classification Search ..... 347/12, 347/14, 15, 19

See application file for complete search history.

(56) References Cited

U.S. PATENT DOCUMENTS 6,511,143 B1 1/2003 Ishikawa et al.
6,659,580 B2 12/2003 Horikoshi

FOREIGN PATENT DOCUMENTS

JP 2000-094662 4/2000
JP 2000-103088 4/2000
JP 2006-062088 3/2006

*Primary Examiner*—Julian D Huffman
(74) *Attorney, Agent, or Firm*—Fitzpatrick, Cella, Harper & Scinto

(57) ABSTRACT

In performing multi-pass printing by using a printhead having a plurality of nozzles, a scan duty setting unit sets a printing amount for each nozzle for each main scan of the printhead based on the scan duty setting LUT. A scan duty setting LUT changing unit updates an initial scan duty setting LUT based on the faulty nozzle information detected by a faulty nozzle detection unit. At this time, the scan duty setting LUT is updated such that the scan duty which should be distributed to a faulty nozzle is distributed to a plurality of other nozzles and neighboring nozzles which print the same main scanning line as that printed by the faulty nozzle.

12 Claims, 18 Drawing Sheets

IMAGE FORMING APPARATUS, IMAGE PROCESSING APPARATUS, AND CONTROL METHOD THEREFOR

BACKGROUND OF THE INVENTION

1. Field of the Invention

The present invention relates to an image forming apparatus, an image processing apparatus, and a control method for them and, more particularly, to an image forming apparatus, an image processing apparatus, and a control method for them, which form an image by scanning a printhead having a plurality of printing elements on a print medium.

2. Description of the Related Art

A general example of an image output apparatus for a word processor, personal computer, facsimile apparatus, and the like is a printing apparatus which prints information such as desired characters and images on a sheet-like print medium such as a paper sheet or film. Such printing apparatuses use various printing methods. Among them, methods of forming an image on a print medium by making ink adhere to the print medium have been widely put into practice. As a typical example of such methods, the inkjet printing method has been known.

In such printing apparatuses, dots formed by printing elements sometimes vary in size and position, resulting in density unevenness in a printed image. In a serial type image forming apparatus, in particular, which performs printing by scanning a printhead in a direction different from the array direction of a plurality of printing elements, e.g., a direction perpendicular thereto, the above density unevenness sometimes appears as stripe unevenness on a printed image, resulting in a further deterioration in the quality of the printed image.

As a printing method for correcting such density unevenness, the multi-pass printing method is known. According to this technique, based on image data having undergone tone reduction processing (e.g., binarization), an image comprising one pixel or a line of pixels corresponding to one scan of printing elements is formed by dots formed by a plurality of different printing elements.

There has been proposed an image processing method in which when an image having undergone tone reduction processing like that described above is to be formed, the formation order and arrangement of the image are determined (see, for example, Japanese Patent Laid-Open No. 2000-103088). According to this technique, even if the registration of each scan varies upon tone reduction processing for each main scan, a deterioration in image quality due to density unevenness and the like can be suppressed.

More specifically, main scanning is performed for the same main scanning print area on a predetermined print medium a plurality of number of times by using different nozzle groups, and a binary image is formed for each main scan by an error diffusion method. When a binary image is generated by executing the error diffusion method for each main scan, the dots arranged within each main scan are high in dispersibility and uniform. Even if, therefore, the physical registration of the feeding amounts of a print medium or the positions of printing elements varies when an image is formed by a plurality of main scans, a change in graininess does not easily occur. In addition, since the correlation in dot arrangement between a plurality of main scans is low, even if registration variations occur, a change in dot coverage relative to the surface of a sheet is reduced, thereby considerably reducing density unevenness.

An error diffusion method is known as a means for converting multi-level input image data into a binary image corresponding to a dot print signal (or an image having the number of tone levels equal to or larger than two and smaller than the number of tone levels of input data). The error diffusion method implements pseudo tone expression by diffusing a binarization error which has occurred in a given pixel to a plurality of subsequent pixels.

In addition to this error diffusion method, a dither method is available as a means for converting multi-level input image data into binary image corresponding to a dot print signal (or an image having the number of tone levels equal to or larger than two and smaller than the number of tone levels of input data). The dither method implements pseudo tone expression by performing binarization by comparing a predetermined threshold matrix with multi-level input data. The dither method is known to be simpler than the error diffusion in terms of processing and hence be capable of high-speed processing.

A printhead used in the inkjet method or the like, which discharges liquid ink, has a very delicate structure, and hence sometimes suffers from a discharge failure as a dye or pigment, which is a dissolved substance in ink, sticks to ink orifices or the like of the printhead or a foreign substance such as dust adheres to ink orifices. This sometimes causes a printing failure in the printing apparatus.

Even in an image forming apparatus using printing elements based on a method (e.g., the electrophotographic method) other than the inkjet method, a printing failure sometimes occurs when printing elements fail or are damaged. When a printing failure occurs in printing elements in this manner, since they form no dots, a printed image does not satisfy a predetermined density. Furthermore, white stripes are formed along the main scanning direction.

There has been proposed a method of performing interpolation in an image forming apparatus based on the inkjet method when there are faulty nozzles. For example, there is available a technique in which when, for example, binarization is performed for a faulty nozzle position, an output value is forcibly set to 0, and an input value is diffused as an error to neighboring pixels by the error diffusion method (see, for example, Japanese Patent Laid-Open No. 2006-62088). According to this method, the density which should be printed by a faulty nozzle is interpolated by making neighboring nozzles of the faulty nozzle print more dots than those that should be printed in each main scan.

As another interpolation method, there is available a technique of assigning dots which should be printed by a faulty nozzle to other nozzles which form the same line by changing a mask table in multi-pass printing in which the positions of dots to be printed in each main scan are determined by the mask table (see, for example, Japanese Patent Laid-Open No. 2000-94662).

The following problems, however, arise in the above conventional faulty nozzle interpolation methods.

According to the method of interpolating the density, which should be printed by a faulty nozzle, by using neighboring nozzles of the faulty nozzle, it is possible to preserve the macroscopic density formed by each main scan. However, when attention is paid to a line in the main scanning direction which should be formed by a faulty line, since the number of dots to print the line cannot be interpolated, a white tripe is formed.

According to the method of assigning dots which should be formed by faulty nozzles to other nozzles which form the same line, the density of the line can be reproduced. This method, however, can be applied to only a case in which it is known in advance which nozzle is used to print which pixel of an image as in the case of multi-pass printing using a mask pattern. For this reason, the method cannot be applied to a case in which binarization is performed for each main scan so as to prevent density unevenness even with variations in registration. In addition, when a mask table is designed to optimize a dot pattern printed in each main scan, the presence of a faulty nozzle changes the mask table. As a consequence, the dot pattern in each main scan is not an optimized pattern.

SUMMARY OF THE INVENTION

The present invention has been made to solve the above problems, and has as its object to provide an image forming apparatus, an image processing apparatus, and a control method therefor which have the following functions. That is, when a printhead having a plurality of printing elements is segmented into a plurality of areas and an image is to be formed on the same area on a print medium by a scan on an area basis, image formation by faulty printing elements is properly interpolated.

According to one aspect of the present invention, an image forming apparatus which forms an image by scanning a printhead having a plurality of printing elements on a print medium is provided. The apparatus includes an input unit configured to input image data, a storage unit configured to store a table in which a printing amount division ratio for each of the printing elements is set for each main scan of the printhead, a setting unit configured to set a printing amount for each of the printing elements for each main scan of the printhead in accordance with the image data based on the table, an N-ary (where N is an integer not less than two) processing unit configured to generate a dot pattern as a formation target by performing N-ary processing for the printing amount set by the setting unit, a detection unit configured to detect a faulty printing element, of the plurality of printing elements, which malfunctions, and an updating unit configured to update the table such that a printing amount which is to be distributed to the faulty printing element detected by the detection unit is distributed to another printing element which prints the same main scanning line as that printed by the faulty printing element.

The present invention can provide an image forming apparatus, an image processing apparatus, and a control method therefor which have the following functions. That is, when a printhead having a plurality of printing elements is segmented into a plurality of areas and an image is to be formed on the same area on a print medium by a scan on an area basis, image formation by faulty printing elements is properly interpolated.

Further features of the present invention will become apparent from the following description of exemplary embodiments with reference to the attached drawings.

DESCRIPTION OF THE EMBODIMENTS

Figure 1:
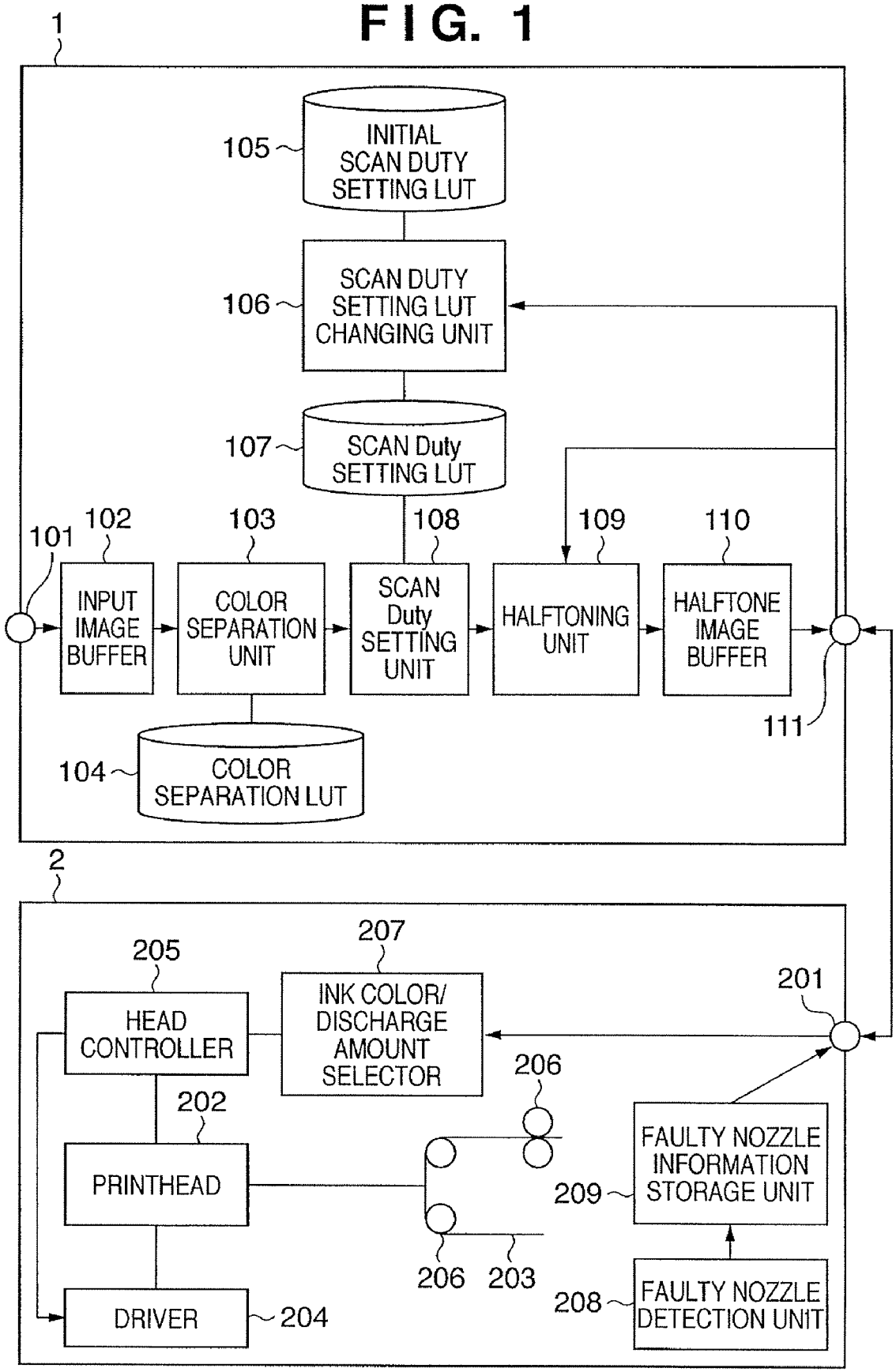
FIG. 1 is a block diagram showing the arrangement of an image forming system in an embodiment of the present invention.

Various exemplary embodiments, features, and aspects of the present invention will be described in detail below with reference to the drawings.

The arrangement in each embodiment described below is merely an example, and the present invention is not limited to the arrangements illustrated in the drawings. Each embodiment exemplifies an image forming apparatus based on the inkjet method. However, the present invention can be applied to image forming apparatuses based on other methods.

First Embodiment

FIG. 1 is a block diagram showing the arrangement of an image forming system according to this embodiment. Referring to FIG. 1, reference numeral 1 denotes an image processing apparatus; and 2, a printer. Note that the image processing apparatus 1 can be implemented by a printer driver installed in a general personal computer. In this case, each unit of the image processing apparatus 1 to be described below is implemented by making a computer execute a predetermined program. Another arrangement is, for example, an arrangement in which the printer 2 includes the image processing apparatus 1.

The image processing apparatus 1 and the printer 2 are connected to each other via a printer interface or a circuit. The image processing apparatus 1 receives image data as a print target from an image data input terminal 101, and stores it in an input image buffer 102. A color separation unit 103 color-separates the input image data into data corresponding to the ink colors of the printer 2. In this color separation processing, a color separation lookup table (LUT) 104 is referred to.

A scan duty setting LUT changing unit 106 changes the contents of an initial scan duty setting LUT 105 based on the faulty nozzle information stored in a faulty nozzle information storage unit 209 in the printer 2, and outputs the LUT as a scan duty setting LUT 107.

A scan duty setting unit 108 converts each ink color value separated by the color separation unit 103 into each ink color value for each scan based on the scan duty setting LUT 107. Scan duty data in this embodiment represents a printing ink amount in each scan.

A halftoning unit 109 converts a value of each multi-tone color (three or more tone levels) obtained by the scan duty setting unit 108 into binary image data based on the faulty nozzle information stored in the faulty nozzle information storage unit 209. A halftone image buffer 110 stores the binary image data of each color obtained by the halftoning unit 109. The binary image data stored in the halftone image buffer 110 is output to the printer 2 via an output terminal 111.

The printer 2 forms the binary image data formed by the image processing apparatus 1 on a print medium by moving a printhead 202 vertically and horizontally relative to a print medium 203. As the printhead 202, a printhead based on the electrophotographic method, thermal transfer method, inkjet method, or the like can be used. Any type of printhead has one or more printing elements (nozzles in the inkjet method). A driver 204 moves the printhead 202 under the control of a head controller 205. A feeding unit 206 feeds a print medium 203 under the control of the head controller 205. An ink color/discharge amount selector 207 selects an ink color from the colors of inks supplied to the printhead 202 and the amount of ink which can be discharged based on the binary image data of each color formed by the image processing apparatus 1.

A faulty nozzle detection unit 208 detects a nozzle in a faulty state among a plurality of nozzles constituting the printhead 202. The information of the detected faulty nozzle is stored in the faulty nozzle information storage unit 209. The faulty nozzle detection unit 208 is preferably capable of individually detecting a discharge failure for each of the nozzles of the printhead 202. Although a plurality of methods of detecting faulty nozzles are conceivable, it suffices to use any of them. These methods include, for example, a method using an optical sensor placed in proximity to the ink flying path, a method of determining faulty nozzles based on a temperature rise caused in the printhead upon idle ink discharge and a subsequent temperature drop, and a method of detecting faulty nozzles by printing a predetermined test pattern on a print medium and reading the pattern.

Figure 2:
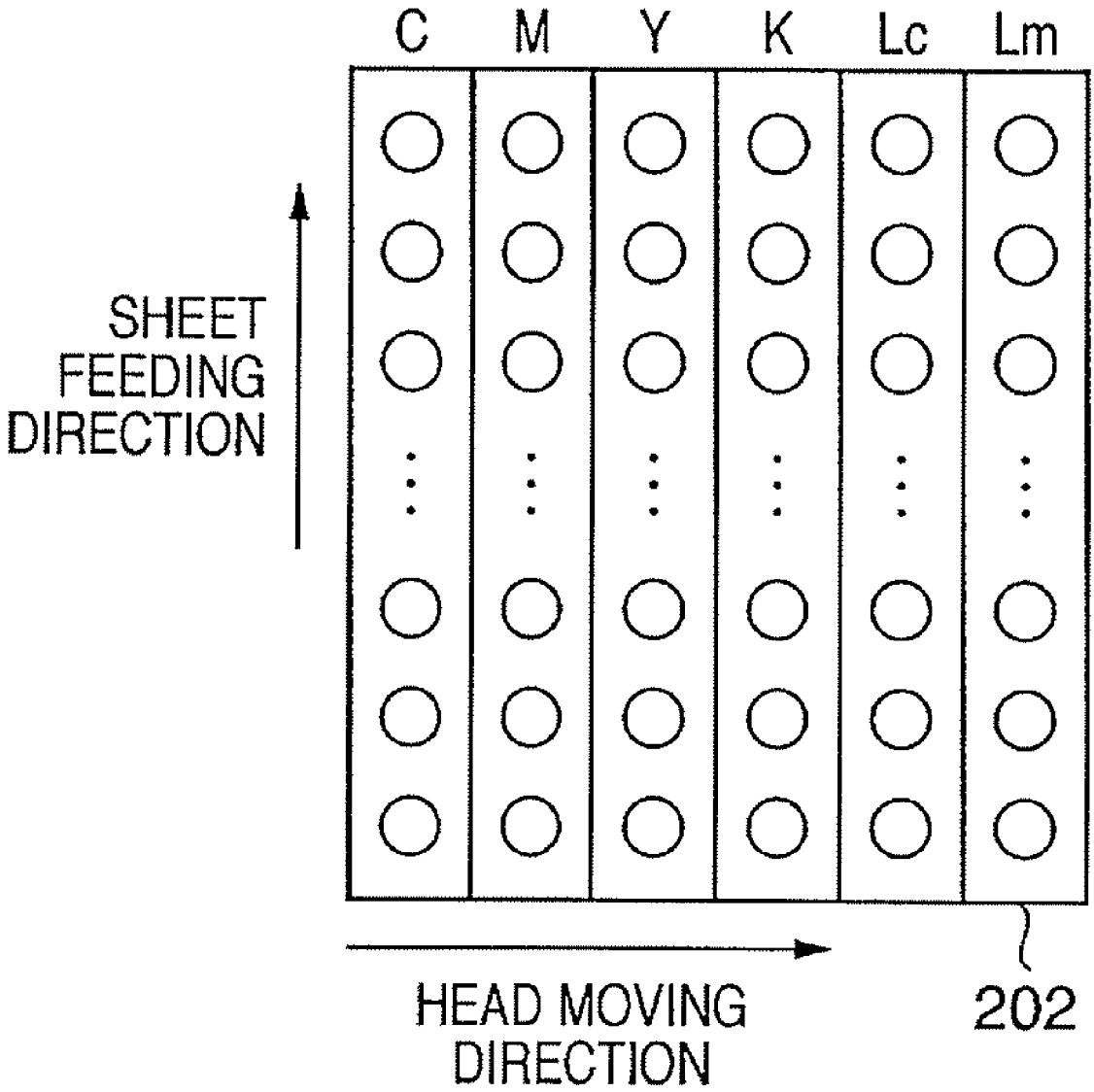
FIG. 2 is a view showing an example of the arrangement of a printhead in a printer according to the embodiment.

FIG. 2 is a view showing an example of the arrangement of the printhead 202. In this embodiment, the printhead 202 is supplied with inks of six colors including inks of light cyan (Lc) and light magenta (Lm) having relatively low ink densities, in addition to inks of four colors of cyan (C), magenta (M), yellow (Y), and black (K).

For simplicity, FIG. 2 shows an arrangement in which nozzles are arranged in a line in the sheet feeding direction. However, the number of nozzles and the arrangement of nozzles are not limited to this example. For example, it suffices to have a nozzle array with the same color and different discharge amounts or a plurality of arrays of nozzles with the same discharge amount. In addition, nozzles may be arranged in a zigzag pattern. Referring to FIG. 2, ink colors are sequentially arranged in a line in the head moving direction. However, they can be arranged in a line in the sheet feeding direction.

Figure 3:
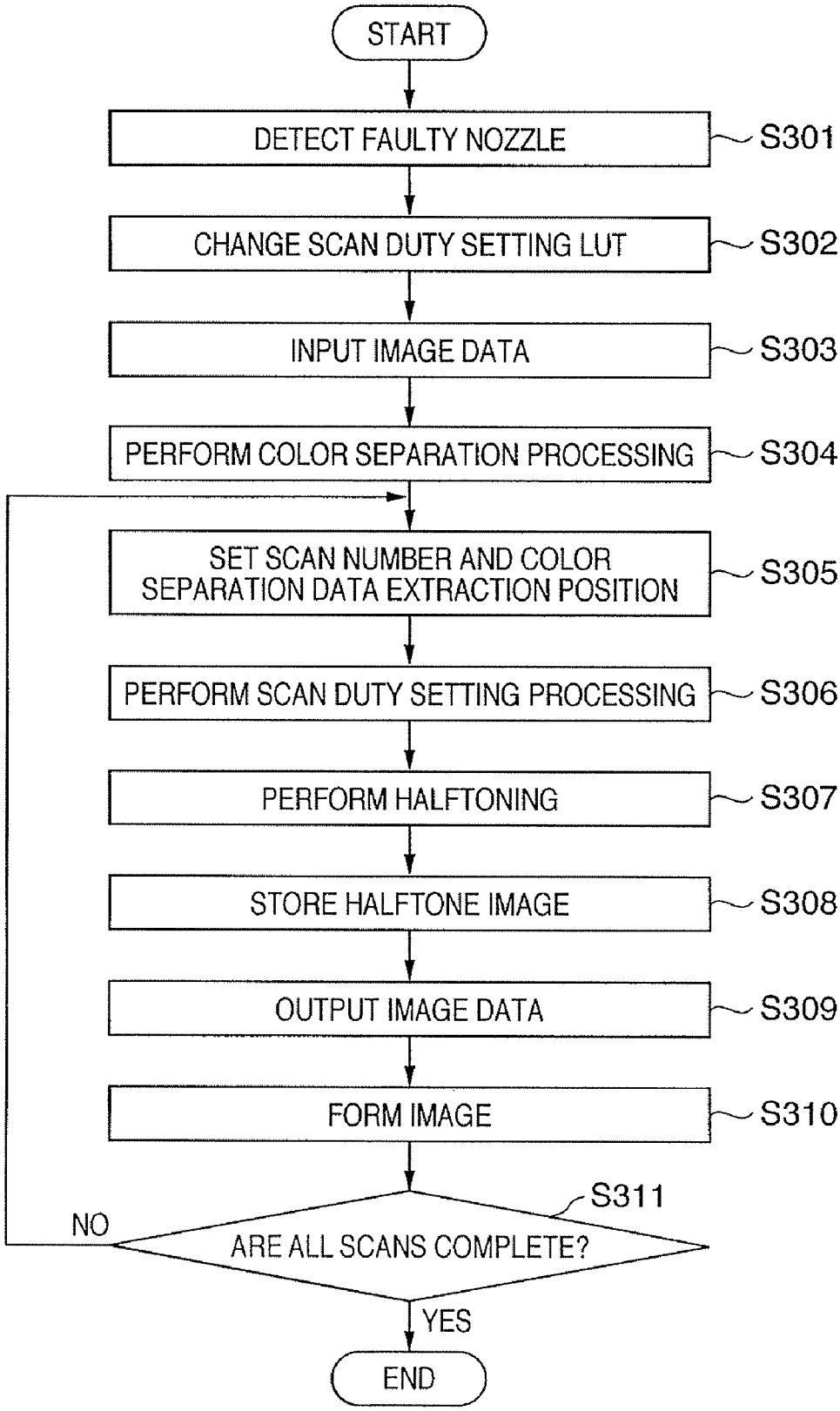
FIG. 3 is a flowchart showing image formation processing in this embodiment.

Processing in the image processing apparatus 1 of this embodiment having the above functional arrangement will be described next with reference to the flowchart of FIG. 3.

First of all, the faulty nozzle detection unit 208 detects a faulty nozzle, and stores the corresponding information in the faulty nozzle information storage unit 209 (S301).

The scan duty setting LUT changing unit 106 then changes the contents of the initial scan duty setting LUT 105 based on the faulty nozzle information in the faulty nozzle information storage unit 209, and stores the resultant LUT as the scan duty setting LUT 107 (S302). If no faulty nozzle is detected because, for example, there is no faulty nozzle, the scan duty setting LUT changing unit 106 stores the initial scan duty setting LUT 105 as the scan duty setting LUT 107 without any change. The details of processing in the scan duty setting LUT changing unit 106 will be described later.

Input multi-tone color image data is input via the input terminal 101 and stored in the input image buffer 102 (S303). In this case, the input image data is color image data comprising three color components of red (R), green (G), and blue (B).

The color separation unit 103 then performs color separation processing for the input multi-tone color image data stored in the input image buffer 102 to convert the RGB data into ink color planes of CMYK and LcLm by using the color separation LUT 104 (S304). In this embodiment, each pixel data after color separation processing is handled as 8-bit data. However, it suffices to convert each pixel data into data with more tone levels.

As described above, the printhead 202 in this embodiment holds six types of ink colors. For this reason, input color image data of RGB is converted into image data of a total of six planes of C, M, Y, K, Lc, and Lm. That is, image data of six types of planes corresponding to six types of ink colors are generated.

Color separation processing in this embodiment will be described in detail below with reference to FIG. 4.

Figure 4:
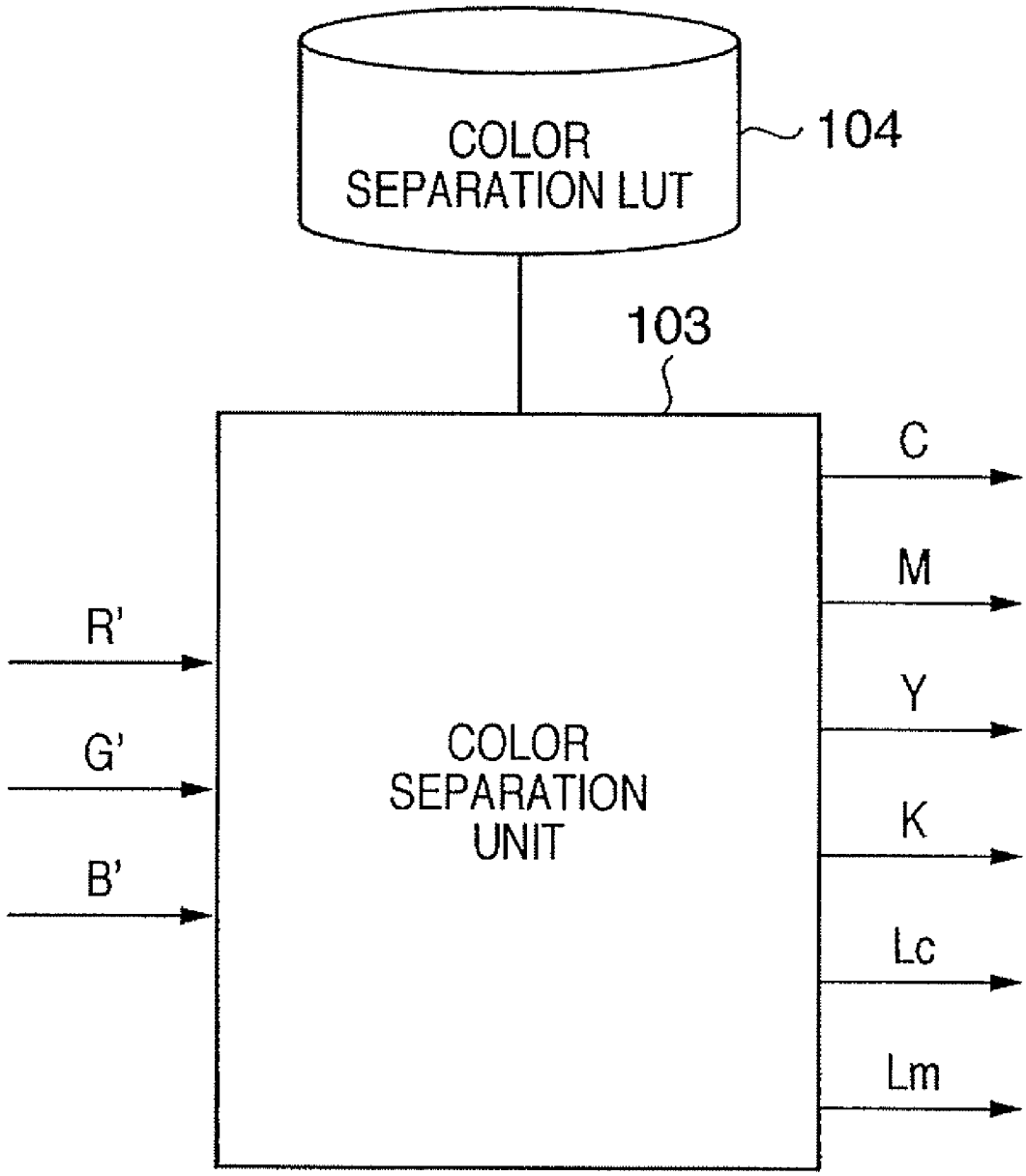
FIG. 4 is a view showing the details of input and output data in a color separation unit in the embodiment.

FIG. 4 shows the details of input and output data in the color separation unit 103. As shown in FIG. 4, input image data R', G', and B' are converted into C, M, Y, K, Lc, and Lm data by referring to the color separation LUT 104 as follows:

$$C=C_LUT_3D(R',G',B') \quad (1)$$

$$M=M_LUT_3D(R',G',B') \quad (2)$$

$$Y=Y_LUT_3D(R',G',B') \quad (3)$$

$$K=K_LUT_3D(R',G',B') \quad (4)$$

$$Lc=Lc_LUT_3D(R',G',B') \quad (5)$$

$$Lm=Lm_LUT_3D(R',G',B') \quad (6)$$

In this case, the respective functions defined by the right-hand sides of equations (1) to (6) correspond to the contents of the color separation LUT 104. The color separation LUT 104 determines output values for the respective ink colors from three input values of red, green, and blue. Since this embodiment is configured to have six colors of C, M, Y, K, Lc, and Lm, a LUT arrangement for obtaining six output values from three input values is used.

With the above processing, the color separation processing in this embodiment is complete.

Referring back to FIG. 3, first of all, the scan duty setting unit 108 sets a scan number and the position (extraction position) of color separation image data to be printed by the corresponding scan (S305). In this case, the extraction position of color separation image data is represented as a subscanning direction pixel position of a line printed by the uppermost nozzle of a nozzle array in each scan. Assume that the subscanning direction pixel position of a line increases in the subscanning direction with the upper end pixel position of an input image being 0, and the opposite direction to the subscanning direction relative to the upper end pixel position 0 being represented by a negative value. In one scan, an image within the range of the length of nozzles is printed from the upper end nozzle.

The operation of a nozzle array in multi-pass printing will be described below.

In multi-pass printing, the sheet feeding amount is set to an amount smaller than the length of the nozzle array, and the nozzle array is scanned on each line of an input image a plurality of number of times, thereby forming an image. Since the sheet is fed for each scan, different nozzles are scanned on a line in the respective scans. Multi-pass printing, therefore, reproduces an input image by dividing the nozzle array into a plurality of nozzle groups in a plurality of scans instead of forming one line of an image by using one nozzle in one scan. In such multi-pass printing, the number of times the nozzle array is scanned on a line will be referred to as the number of passes.

In multi-pass printing with a constant sheet feeding amount, a line whose subscanning direction pixel position is represented by y is printed by nozzles equal in number to Pass (Pass is the number of passes) which are indicated by nozzle numbers i ($0 \leqq i \leqq Nzzl$) satisfying the following equation:

$$i\%(Nzzl/Pass)=y\%(Nzzl/Pass) \quad (7)$$

where % represents an operation for obtaining the remainder of division.

Nozzle numbers which satisfy equation (7) and are used to form the same line will be referred to as "corresponding nozzles".

Figure 5:
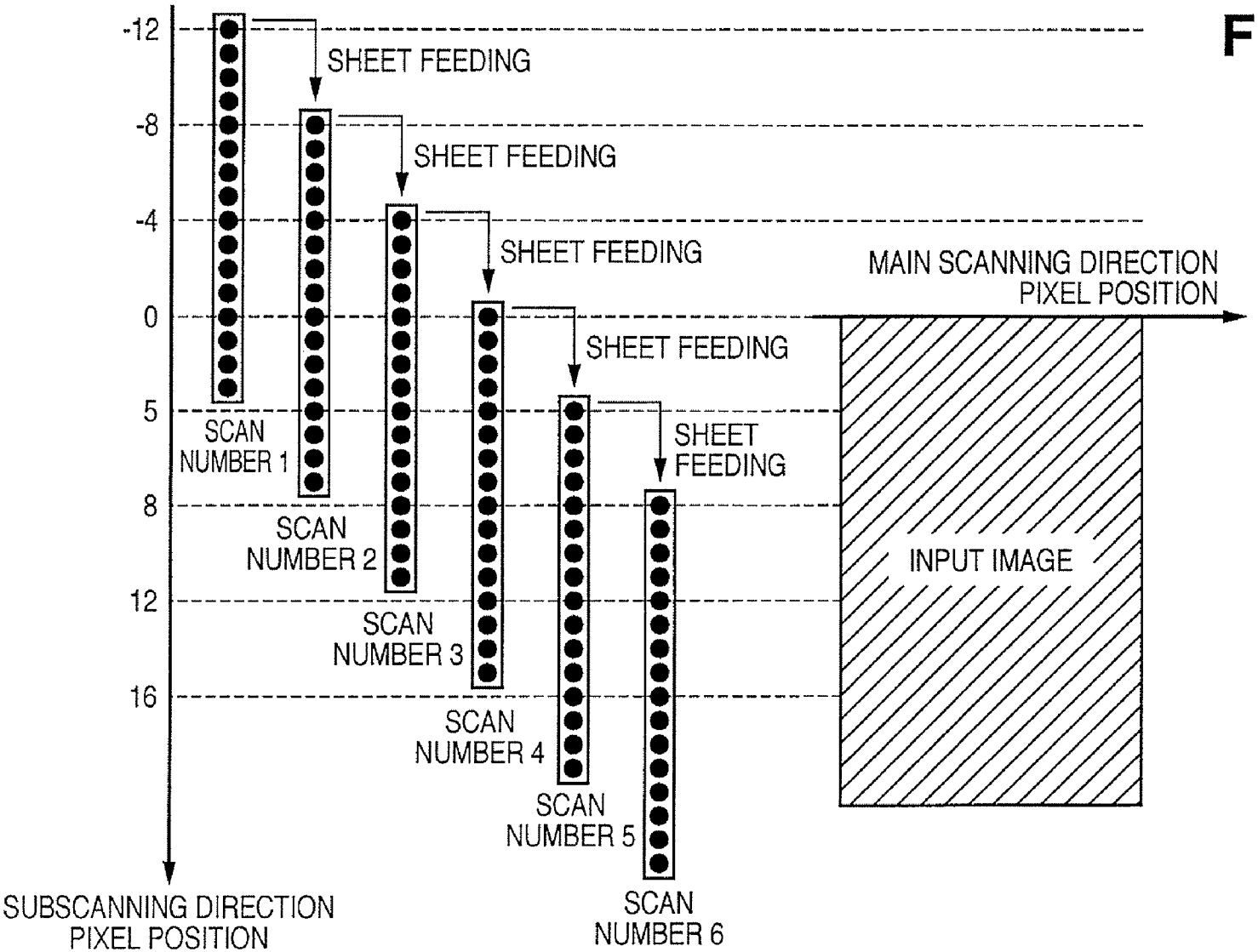
FIG. 5 is a view for explaining an example of the operation of a nozzle array in multi-pass printing in the embodiment.

FIG. 5 shows an example of the operation of a nozzle array in multi-pass printing. Although FIG. 5 illustrates each nozzle array in a state shifted in the main scanning direction to illustrate the nozzle array in each scan on the drawing surface, sheet feeding is actually performed in only the subscanning direction.

FIG. 5 shows a case in which the number of nozzles is 16 (Nzzl=16) and the sheet feeding amount is ¼ the nozzle array length. That is, FIG. 5 shows an example of four-pass printing operation of scanning on each line of an input image four times.

Referring to FIG. 5, at scan number 1, since only the lower ¼ part of the nozzle array is used, an image is formed by performing a scan with the upper end nozzle being located at the position "−12". At scan number 2, after the sheet is fed by ¼ the head length, image formation is performed by performing a scan with the upper end nozzle being located at the position "−8". Subsequently, sheet feeding by ¼ the head length and a scan are repeated. This makes it possible to obtain the correspondence between a scan number and a position in an image at which the upper end nozzle performs image formation in each scan (color separation data extraction position Ycut).

A position where image formation is performed in each scan, i.e., the color separation data extraction position Ycut, can be generalized. Let Pass be the number of passes and Nzzl be the number of nozzles in one nozzle array. In this case, if the amount of sheet feeding (Nzzl/Pass) performed between the respective scans is constant, an extraction position Ycut (k) of color separation data to be printed at an arbitrary scan number k ($1 \leqq k$) is represented by $$Ycut(k)=-Nzzl+(Nzzl/Pass)\times k \quad (8)$$

When an image formation position in each scan is set in the above manner, the scan duty setting unit 108 sets duty value for each scan based on the scan duty setting LUT 107 and the image data of each color separation plane (S306).

The contents of the scan duty setting LUT 107 will be described below.

The scan duty setting LUT 107 indicates how much % of color separation data is printed by each nozzle in one scan. That is, since an input duty is divided into duties for a plurality of scans, and each duty indicates how much % of the input duty is used for printing by each nozzle, the values stored in the scan duty setting LUT 107 will be referred to as duty division ratios hereinafter.

The scan duty setting LUT 107 is generated to reproduce color separation image data by scans equal in number to the number of passes. Let i1, i2, . . . , iPass be Pass corresponding nozzles to be used to print a line with an arbitrary subscanning direction pixel position y. Letting LUT(i1), LUT(i2), . . . , LUT(iPass) be the division ratios in the scan duty setting LUT 107 which correspond to the respective nozzles, the values in the scan duty setting LUT 107 hold the following relationship:

$$LUT(i1)+LUT(i2)+\ldots+LUT(iPass)=100[\%] \quad (9)$$

Satisfying the relationship represented by equation (9) makes it possible to reproduce color separation image data. The distribution of LUT(i) can take any form as long as the above relationship is satisfied.

Figure 6:
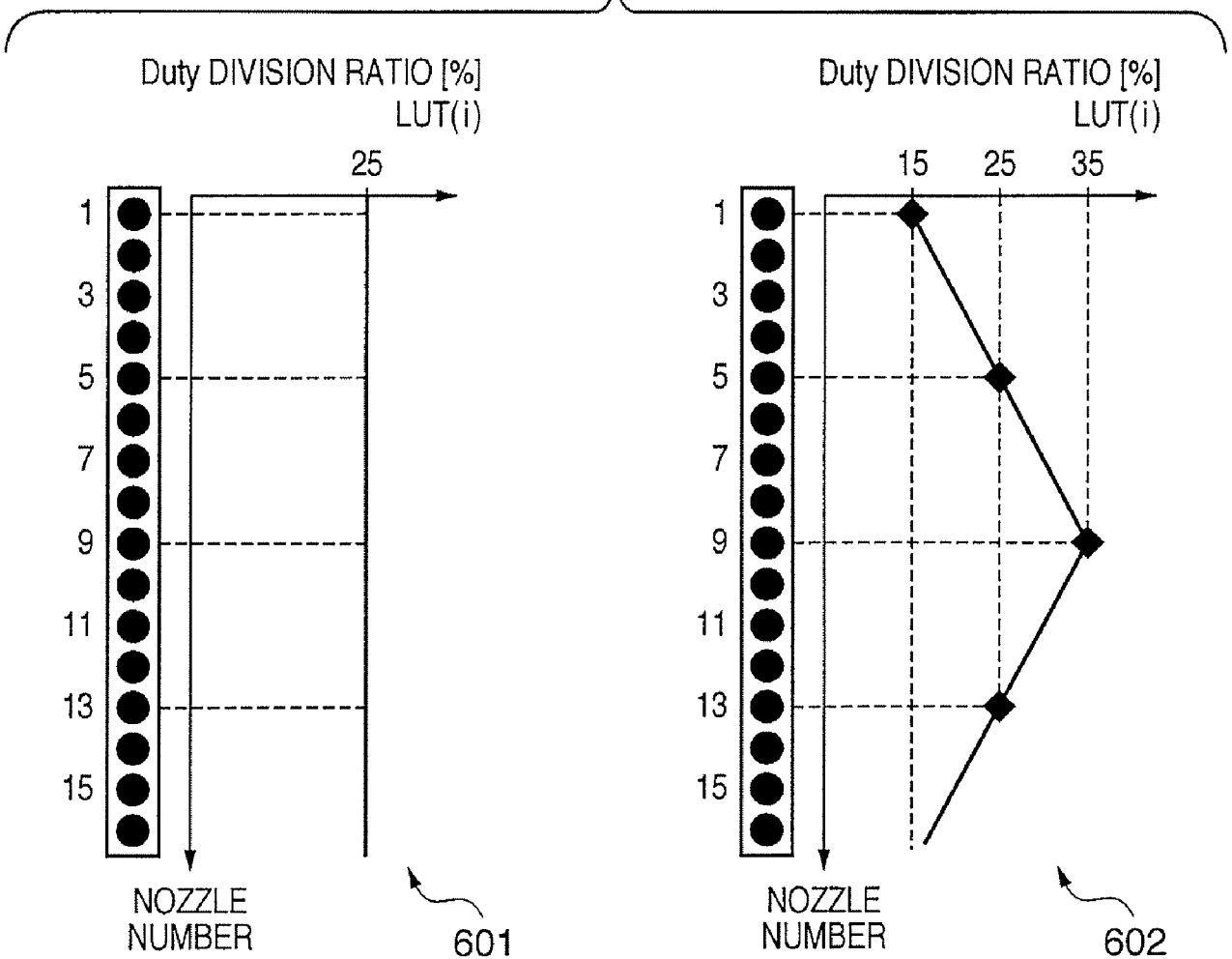
FIG. 6 is a view showing an example of the data stored in a scan duty setting LUT in the embodiment.

FIG. 6 shows an example of data in the scan duty setting LUT 107 in the case of four-pass printing with 16 nozzles. Referring to FIG. 6, the ordinate represents the nozzle number; and the abscissa, the duty division ratio for each nozzle. Reference numeral 601 in FIG. 6 denotes an example of printing by four scans at a uniform ratio. That is, the division ratios for all the nozzles are set to 25% to perform printing with a duty of 25% of input data in one scan. In contrast, reference numeral 608 in FIG. 6 denotes an example of changing the ratio of printing performed by the respective nozzles in each scan. As described above, however, the sum of division ratios for the corresponding nozzles needs to be 100%. In this case, since four-pass printing is performed, nozzle numbers 5, 9, and 13 correspond to nozzle number 1. Obviously, the division ratios for the respective nozzles are 15%, 25%, 35%, and 25%, and the sum of the division ratios is 100%.

Figure 7:
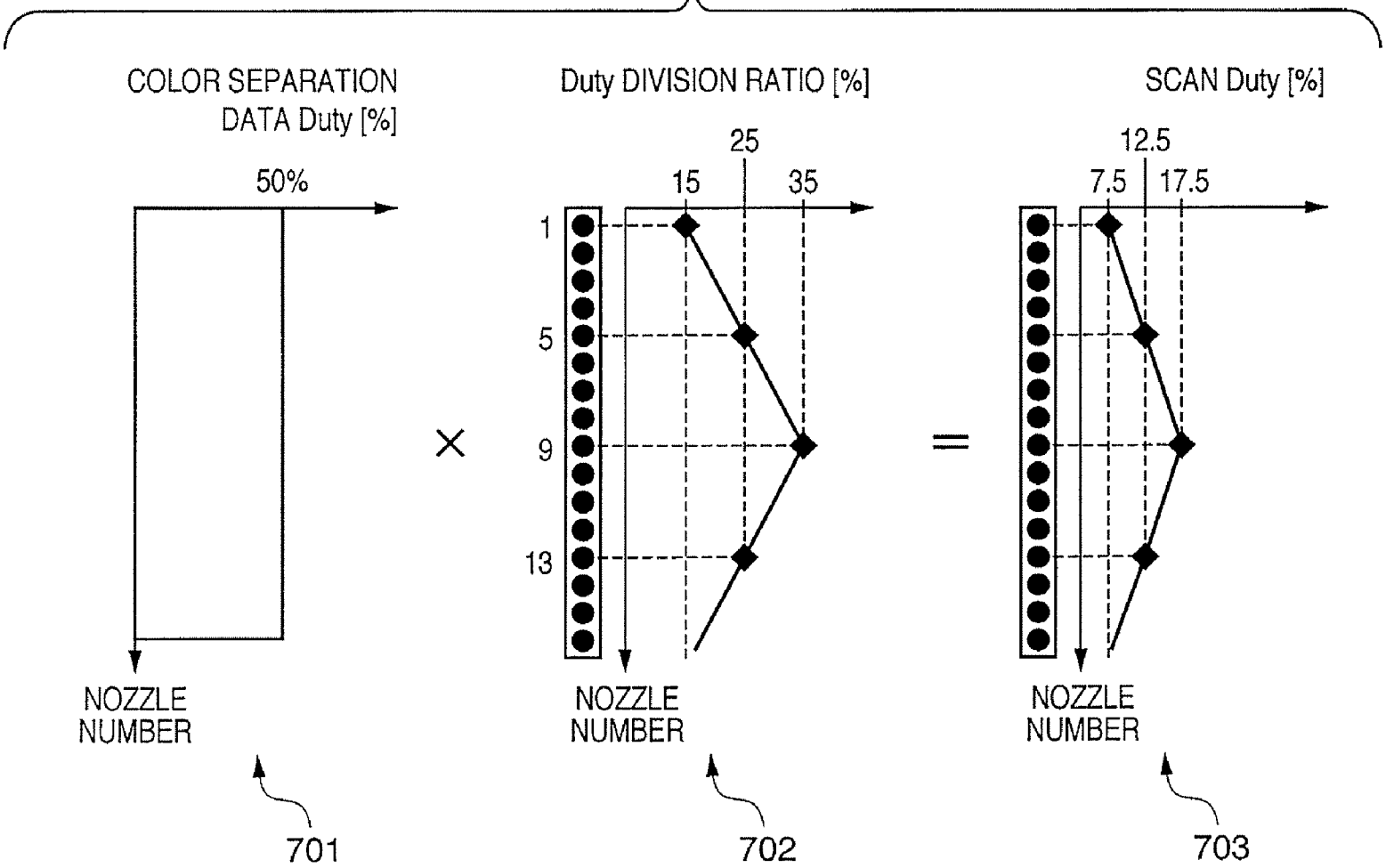
FIG. 7 is a view showing an outline of a method of calculating scan duties in the embodiment.

In step S306, scan duties for the respective scans are set as the products of the duty division ratios stored in the scan duty setting LUT 107 and color separation data. FIG. 7 shows an example of the products of an area corresponding to 50% color separation data and the values in the scan duty setting LUT 107.

The scan duties set in step S306 are the products of values in the scan duty setting LUT 107 and color separation data. Referring to FIG. 7, reference numeral 701 denotes image data after color separation which is to be printed by a scan and represents image data in the subscanning direction at a given pixel position in the main scanning direction. The ordinate in FIG. 7 represents the nozzle number at which a line is printed by the corresponding scan. Reference numeral 702 denotes the scan duty setting LUT 107. For example, at nozzle number 5, since the data after color separation corresponds to a duty of 50% and the division ratio is 25%, the scan duty of 12.5% is obtained from the product of them. It is possible to calculate scan duties for the remaining nozzles by multiplying data after color separation and the division ratios for the respective nozzles in the same manner. Reference numeral 703 denotes the result obtained by calculating scan duties from the products of color separation data and values in the scan duty setting LUT 107.

Figure 8:
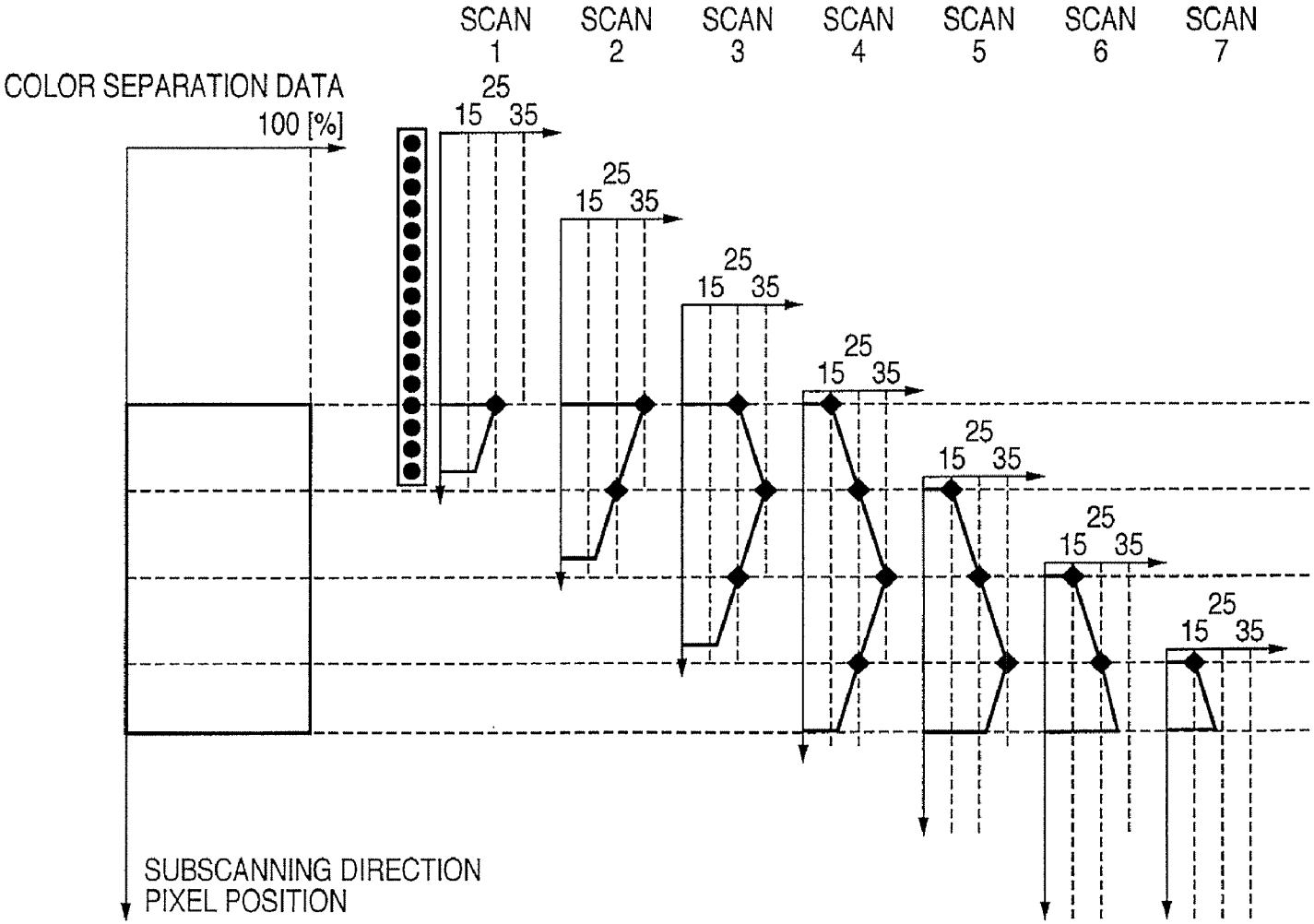
FIG. 8 is a view showing an example of a scan duty for each main scan in the embodiment.

FIG. 8 shows an example of the scan duties obtained by segmenting an area in which data after color separation corresponds to a duty of 100% into areas corresponding to scan numbers 1 to 7. Note that as the scan duty setting LUT 107, the data denoted by reference numeral 602 in FIG. 6 is used. At any subscanning direction pixel position, the sum of duties formed by four scans is 100%, and hence it is obvious that input color separation data can be properly reproduced.

The operation of the scan duty setting unit 108 has been described above. The scan duty setting unit 108 operates in the same manner regardless of whether there is a faulty nozzle.

Referring back to FIG. 3, the halftoning unit 109 performs halftoning to convert the scan duty data of the 8-bit plane obtained by the scan duty setting unit 108 into a two-tone level value (binary data) (S307).

In halftoning in this embodiment, for example, a known error diffusion method is used as the processing of converting multi-level input image data into a binary image (or an image having the number of tone levels equal to or larger than two and smaller than the number of tone levels of input data). Note that the conversion processing to a binary image in this embodiment is not limited to the error diffusion method. For example, this processing may be the processing of performing binarization using a dither matrix or the processing of making binarization results in the respective scans have some kind of complementary relationship or correlation.

If there is a possibility that a dot may be generated even when a binarization target pixel has a pixel value of 0 as in the case of error diffusion processing in which a threshold is changed to prevent the occurrence of texture or a dot generation delay, binarization must be controlled to inhibit the generation of a dot by a faulty nozzle. That is, it suffices to obtain faulty nozzle information in advance by using the faulty nozzle information storage unit 209 and forcibly output 0 at the time of binarization of a pixel formed by the faulty nozzle regardless of the magnitude of a total error between a threshold and neighboring pixels.

The halftone image buffer 110 stores the binary image data after the above halftoning (S308). Letting m be the number of planes of the input image after color separation described above, and n be the number of passes in multi-pass printing method to be described later, the size of the halftone image buffer 110 is represented as follows. That is, this buffer has a storage area O(x, y, j, k) ($0 \leqq x \leqq W$, $0 \leqq y \leqq H$, $0 \leqq j \leqq m$, and $0 \leqq k \leqq n$) equal in size to number W of pixels (horizontal)× number H of pixels (vertical) of an input image, and stores n×m binary image data corresponding to the respective pixel positions.

Note that in this embodiment, binary image data corresponding to the respective colors are generated by sequentially inputting pixels corresponding to the respective planes. It is therefore not necessary to prepare a memory space large enough to hold all the planes of a multi-level image. Likewise, the halftone image buffer 110 can be a memory space with a size necessary for printing operation, for example, on a band basis.

Image data after halftoning is output from the output terminal 111 in an arbitrary size corresponding to, for example, the entire image or the band width of a unit print area (S309).

Upon receiving halftone image data, the printer 2 stores the image data in a halftone image memory. An ink color/discharge amount selector 207 selects an ink color and discharge amount suitable for the image data, and printing operation starts (S109). In this printing operation, the printhead 202 drives the respective nozzles at predetermined driving intervals while moving from left to right relative to the print medium, thereby printing an image on the print medium. Note that this embodiment uses the multi-pass printing method of completing an image by scanning the printhead 202 on a print medium a plurality of numbers of times.

Every time a scan is complete, it is determined whether all scans are complete (S311). If all the scans are not complete, the process returns to step S305. If all the scans are complete, the image formation processing is terminated. With the above operation, the series of image formation processing for the input multi-tone color image data is terminated.

Figure 9:
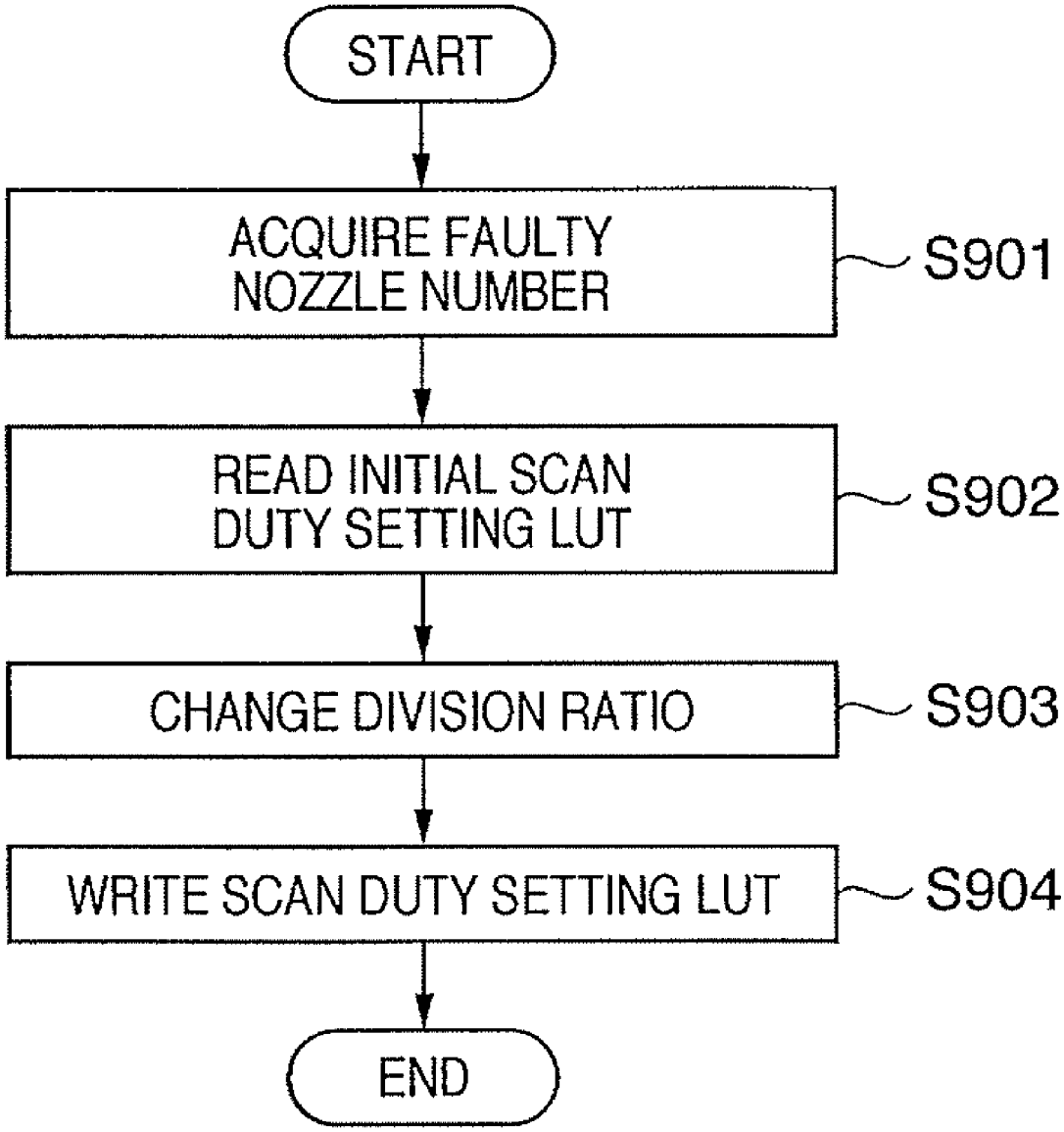
FIG. 9 is a flowchart showing the processing of changing a scan duty setting LUT in the embodiment.

The operation of the scan duty setting LUT changing unit 106 in step S302 will be described in detail below with reference to the flowchart of FIG. 9.

First of all, the scan duty setting LUT changing unit 106 acquires the nozzle number of a faulty nozzle from the faulty nozzle information storage unit 209 (S901), and reads out the initial scan duty setting LUT 105 (S902). The scan duty setting LUT changing unit 106 then divides the initial division ratio of the faulty nozzle into division ratios and adds them to the initial division ratios of nozzles corresponding to the faulty nozzle, i.e., nozzles which print the same line as that of the faulty nozzle (S903). A method of dividing the initial division ratio of the faulty nozzle can be a method of uniformly dividing the initial division ratio for all the corresponding nozzles or a method of dividing the initial division ratio in accordance with the initial division ratios of the corresponding nozzles. After the division processing, the division ratio of the faulty nozzle is changed to 0%. Finally, the scan duty setting LUT whose division ratios have been changed in step S903 is stored as the scan duty setting LUT 107 (S904).

Figure 10:
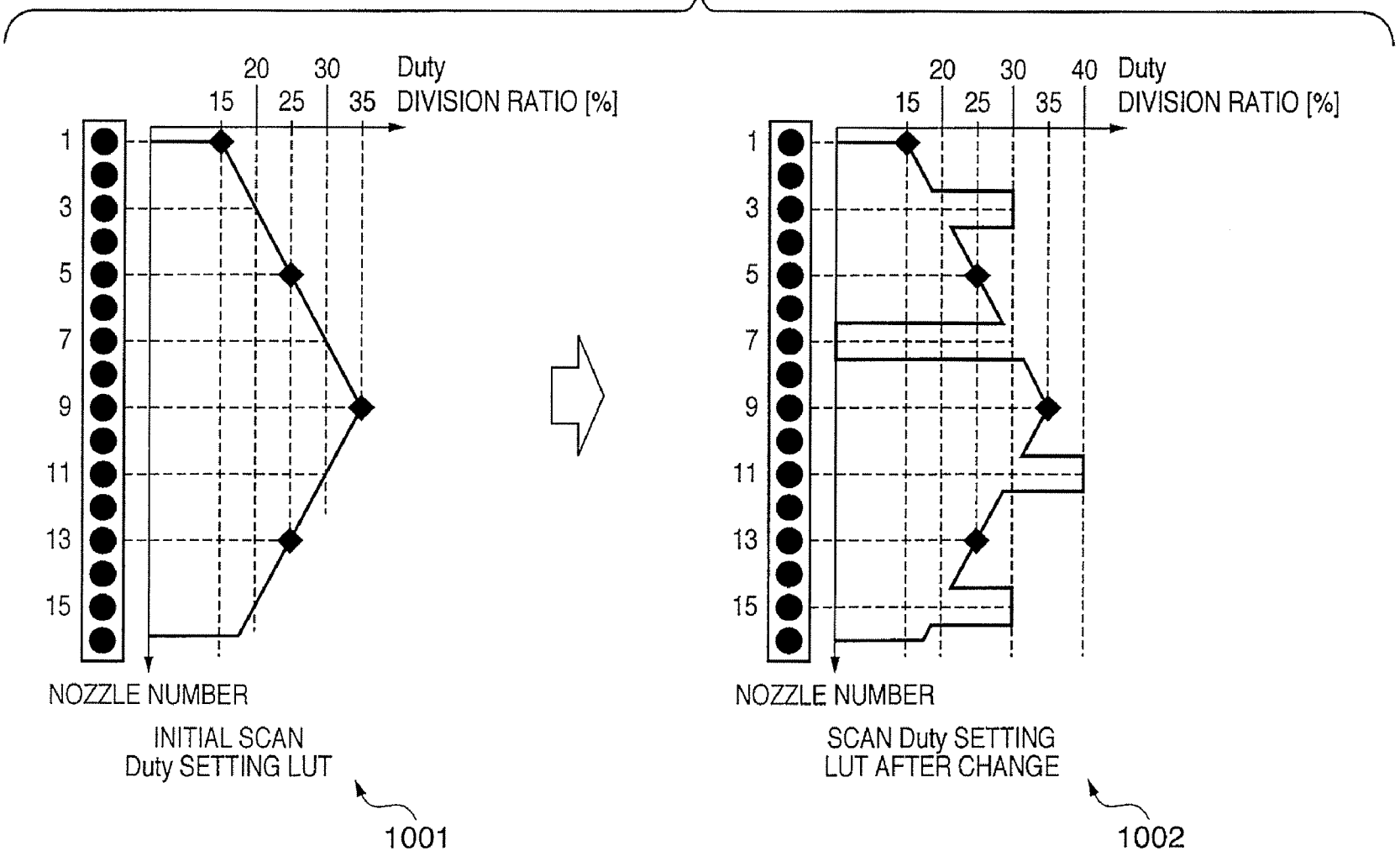
FIG. 10 is a view showing an example of how a scan duty setting LUT is changed in the embodiment.

The processing of changing a scan duty setting LUT in this embodiment will be specifically described below. FIG. 10 shows an example of how a scan duty setting LUT is changed when nozzle number 7 corresponds to a faulty nozzle in four-pass printing with 16 nozzles as in the case shown in FIG. 6. FIG. 10 shows a method of uniformly dividing the initial division ratio of the faulty nozzle.

Referring to FIG. 10, reference numeral 1001 denotes the initial scan duty setting LUT 105; and 1002, the scan duty setting LUT 107 after a change. Nozzles whose division ratios are to be changed are three nozzles with nozzle numbers 3, 11, and 15 corresponding to nozzle 7 corresponding to the faulty nozzle. As denoted by reference numeral 1001, the initial division ratio corresponding to nozzle number 7 is 30%. This division ratio is uniformly divided by three, and each of the resultant division ratios, which is 10%, is added to each of the division ratios of the three nozzles. As a result, as denoted by reference numeral 1002, after this change, the division ratios corresponding to nozzle numbers 3, 11, and 15 are respectively 30%, 40%, and 30%. The division ratio corresponding to nozzle number 7 corresponding to the faulty nozzle is 0%.

Figure 11:
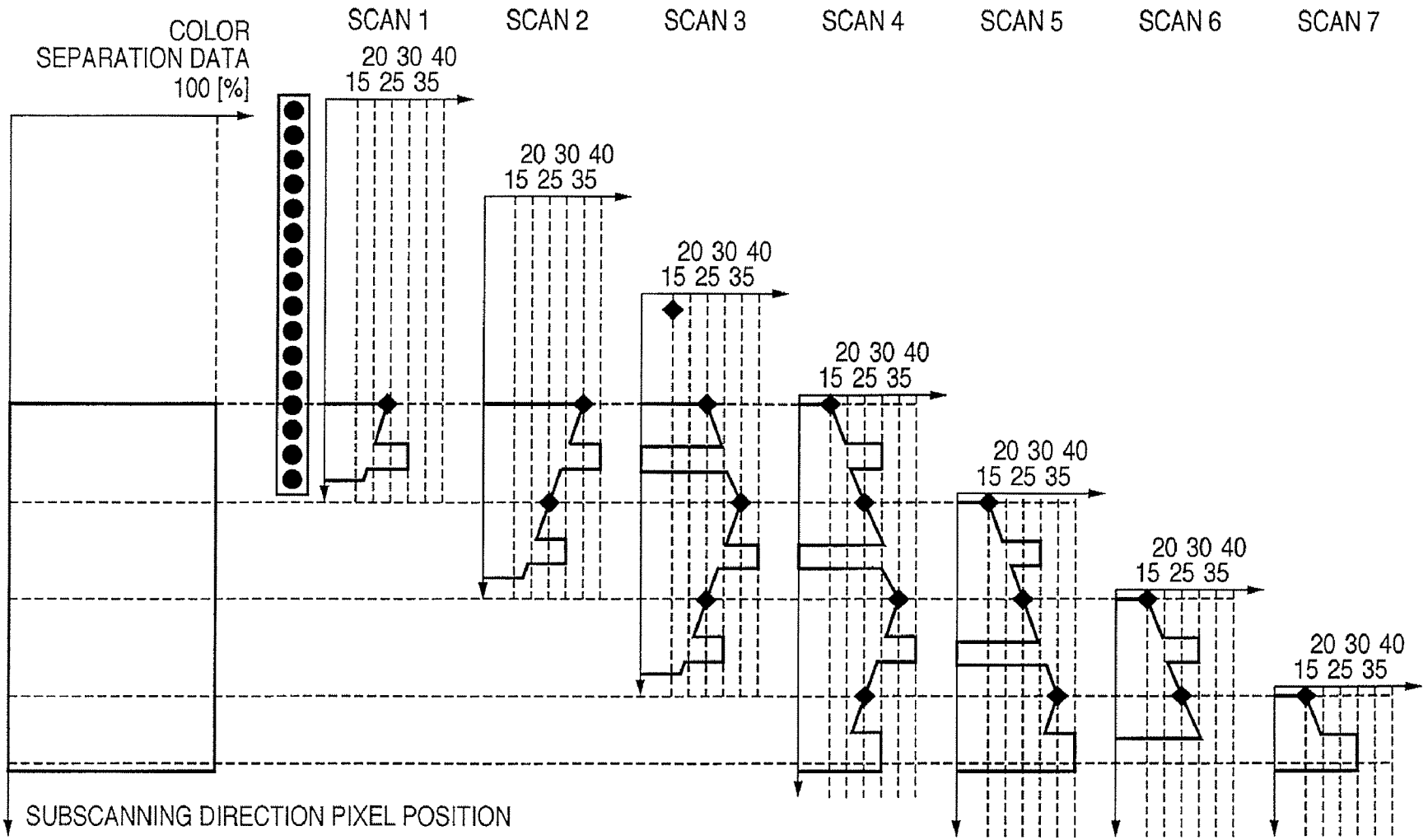
FIG. 11 is a view showing an example of a scan duty for each main scan in a case in which a scan duty setting LUT is used in the embodiment.

FIG. 11 shows how an area with a duty of 100% is scanned by using the scan duty setting LUT 107 after the change which is denoted by reference numeral 1002 in FIG. 10. Referring to FIG. 11, it is obvious that the input duty is reproduced by interpolating the duty, which should be set for printing by the faulty nozzle with nozzle number 7, using the three nozzles with nozzle numbers 3, 11, and 15. As described above, according to this embodiment, even if there is a faulty nozzle, density can be reproduced on all lines, thereby suppressing the formation of white stripes.

Note that this embodiment has been described on the premise that the sheet feeding amount is always constant. Therefore, the relationship between a faulty nozzle and corresponding nozzles is always constant. For this reason, the above description has exemplified the case in which the scan duty setting LUT is changed once before the start of printing, as shown in FIG. 3. However, the present invention can also be applied to a case in which the sheet feeding amount changes for each scan. In this case, since a faulty nozzle and corresponding nozzles change for each operation, the scan duty setting LUT is changed for each scan.

As described above, according to this embodiment, it is possible to interpolate the duty which should be set for printing by a faulty nozzle between a plurality of nozzles which print the same line in different scans when multi-pass printing is performed. This can further suppress the formation of white stripes as compared with the case of interpolation using neighboring nozzles of a faulty nozzle within the same scan. In addition, obtaining a binary dot pattern for each scan after duty correction instead of changing a dot pattern for each scan makes it possible to print the binary dot pattern obtained by binarization without any change. That is, using the error diffusion method and the like can improve the dispersibility of a dot pattern for each scan.

Second Embodiment

The second embodiment of the present invention will be described below. The first embodiment described above has exemplified the case in which the division ratio of a faulty nozzle is interpolated by only nozzles corresponding to the faulty nozzle. In this case, however, when, for example, an error occurs in a sheet feeding amount, the scanning positions of nozzles corresponding to the faulty nozzle shift, and the interpolation relationship deteriorates, resulting in the formation of white stripes. The second embodiment is therefore characterized in that the division ratio of a faulty nozzle is distributed to not only nozzles corresponding to the faulty nozzle but also a plurality of neighboring nozzles to suppress the formation of white stripes even if an error occurs in a sheet feeding amount.

Figure 12:
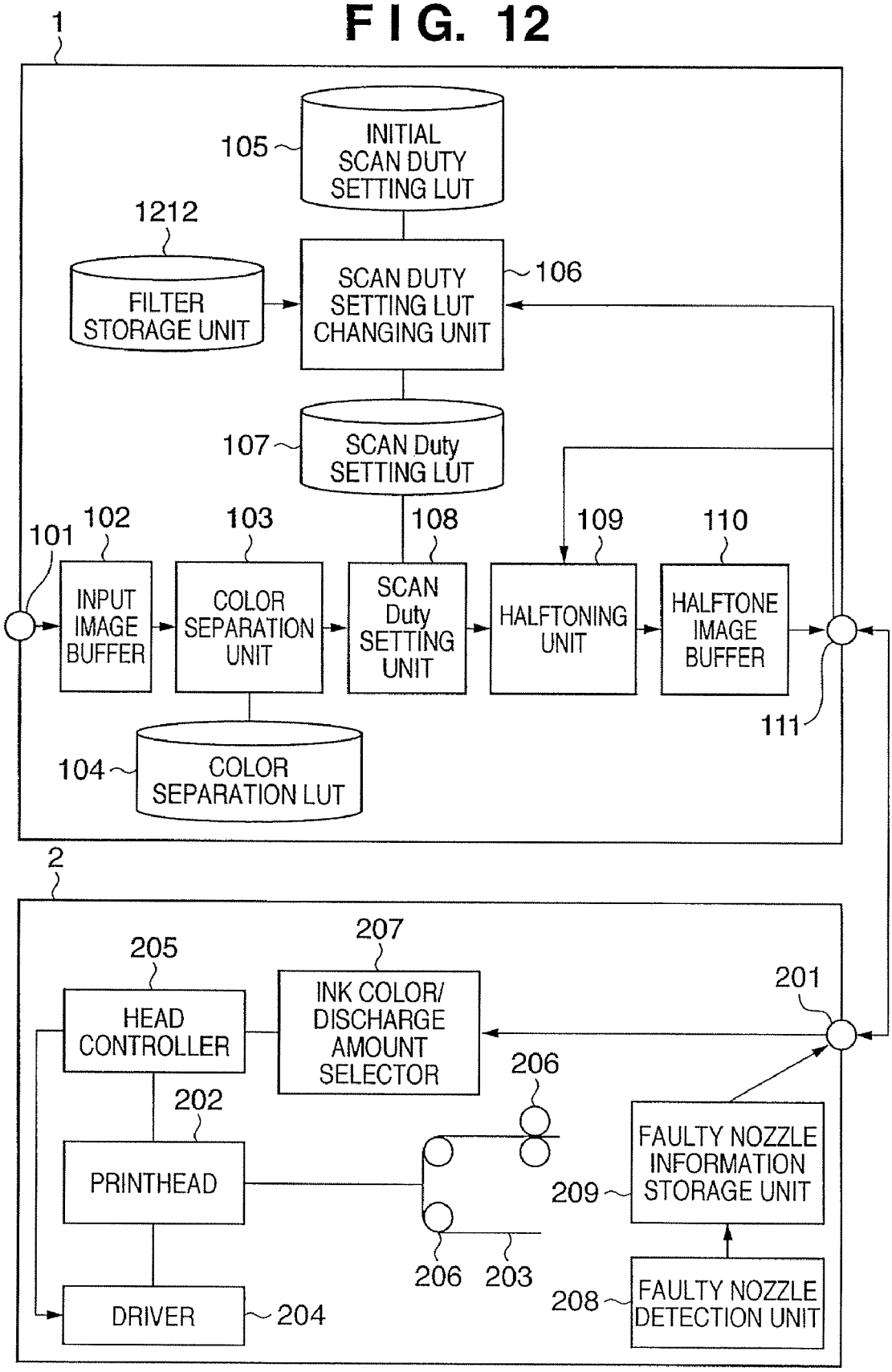
FIG. 12 is a block diagram showing the arrangement of an image forming system in the second embodiment.
Figure 13:
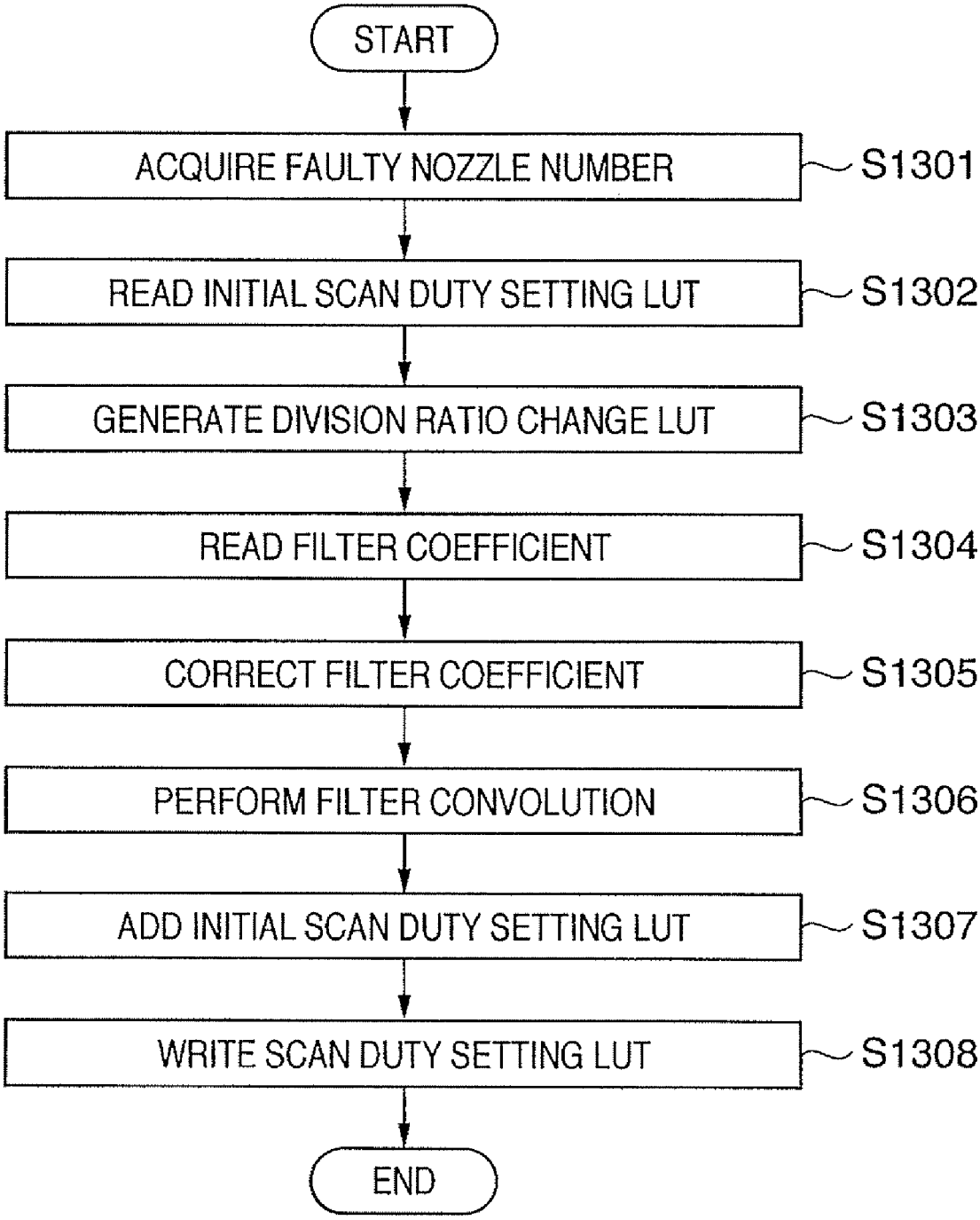
FIG. 13 is a flowchart showing the processing of changing a scan duty setting LUT in the second embodiment.

FIG. 12 is a block diagram showing the arrangement of an image forming system according to the second embodiment. The arrangement shown in FIG. 12 additionally includes a filter storage unit 1212 connected to a scan duty setting LUT changing unit 106 as compared with the arrangement shown in FIG. 1 in the first embodiment described above. The operation of the scan duty setting LUT changing unit 106 in the second embodiment differs from that in the first embodiment. Other arrangements are the same as those in the first embodiment, and hence a repetitive description will be omitted. The operation of the scan duty setting LUT changing unit 106 in the second embodiment will be described in detail with reference to the flowchart of FIG. 13.

First of all, the scan duty setting LUT changing unit 106 acquires the nozzle number of a faulty nozzle from a faulty nozzle information storage unit 209 (S1301), and reads out an initial scan duty setting LUT 105 (S1302).

The scan duty setting LUT changing unit 106 then determines nozzles to which the initial division ratio of the faulty nozzle is to be distributed, and generates a division ratio change LUT in which the change amounts of distribution ratios from the initial scan duty setting LUT 105 are recorded (S1303). In this stage, the initial division ratio of a faulty nozzle is distributed to only nozzles corresponding to the faulty nozzle, and the distributed amounts are set as change amounts. The sum of change amounts of the nozzle positions corresponding to the faulty nozzle is set to coincide with the initial division ratio of the faulty nozzle. The initial division ratio of the faulty nozzle can be uniformly distributed to the respective corresponding nozzles, or can be distributed in accordance with the initial division ratios of the corresponding nozzles. Note that the change amount of the faulty nozzle is set to the negative value obtained by multiplying its initial division ratio by "−1".

When a division ratio change LUT is generated in the above manner, the scan duty setting LUT changing unit 106 obtains the change amounts of the division ratios of the neighboring nozzles of nozzles corresponding to the faulty nozzle and of the neighboring nozzles of the faulty nozzle. In the second embodiment, these change amounts are calculated by convoluting a predetermined filter with the division ratio change LUT generated in step S1303. The calculation of the change amounts of the division ratios of neighboring nozzles by this filter convolution will be described below. A method of calculation of the division ratio change amounts of neighboring nozzles is not limited to such filter convolution.

First of all, a filter coefficient stored in advance in the filter storage unit 1212 is read out (S1304). In this case, the filter size is arbitrary, and the filter coefficient is 1 at the filter center and an arbitrary real number equal to more than 0 and equal to or less than 1 at a position other than the center. The coefficient preferably converges to 0 at the two ends of the filter.

The readout filter coefficient is then corrected in accordance with the initial scan duties near the faulty nozzle (S1305). This correction is performed to prevent the division ratios near the faulty nozzle which are finally calculated in step S2307 to be described later from becoming negative values. More specifically, the correction is performed by multiplying the filter coefficient at a position at a distance y from the filter center by the ratio between the initial division ratio of the nozzle at a position at the distance y from the faulty nozzle and the initial division ratio of the faulty nozzle. In the following equation, let Fil(y) be a filter coefficient before correction, Fil'(y) be the filter coefficient after correction, and LUT(y) be an initial scan duty setting LUT, and y=0 represents the central position of the filter. In addition, the nozzle number of the faulty nozzle is represented by y0.

$$Fil'(y)=Fil(y)\times \mathrm{LUT}(y+y0)/\mathrm{LUT}(y0) \tag{10}$$

The division ratio change LUT generated in step S1303 is regarded as a one-dimensional digital signal value, and the filter corrected in step S1305 is convoluted (S1306).

Finally, the division ratio change LUT after filter convolution which is generated in step S1306 is added to the initial scan duty setting LUT 105 (S307), and the resultant data is stored as a scan duty setting LUT 107 (S1308).

Figure 14:
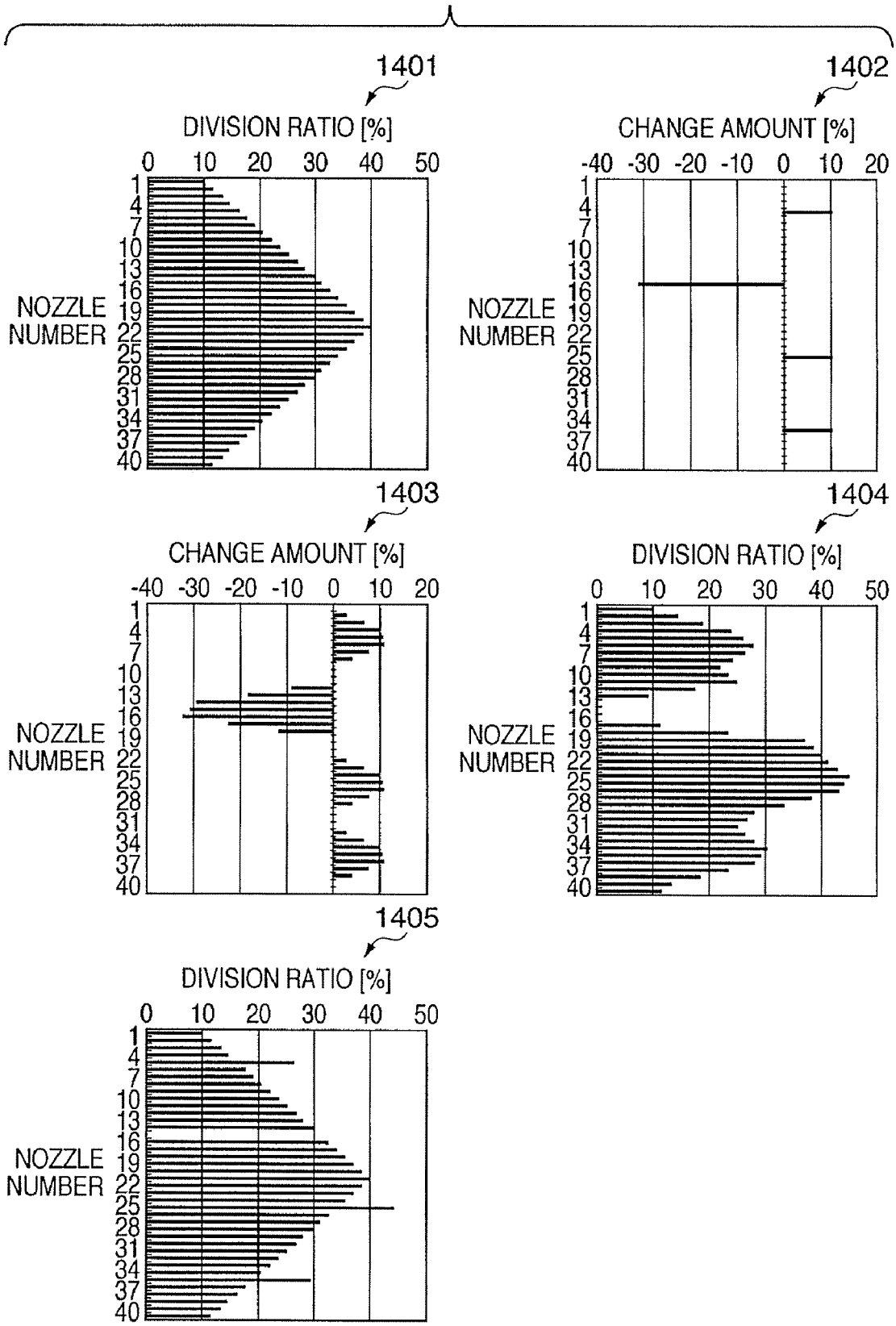
FIG. 14 is a view showing an example of how the scan duty setting LUT is changed in the second embodiment.

The processing of changing a scan duty setting LUT in the second embodiment will be specifically described below. FIG. 14 shows an example of how a scan duty setting LUT is changed when the nozzle with nozzle number 15 is a faulty nozzle in four-pass printing with 40 nozzles. The following exemplifies the method of uniformly distributing the initial division ratio of the faulty nozzle to corresponding nozzles. Note that the nozzles corresponding to nozzle number 15 of the faulty nozzle are three nozzles with nozzle numbers 5, 25, and 35.

Referring to FIG. 14, reference numeral 1401 denotes the initial scan duty setting LUT 105; and 1402, a division ratio change LUT obtained by uniformly distributing the initial division ratio of the faulty nozzle denoted by reference numeral 1401 to the three nozzles with nozzle numbers 5, 25, and 35. In the LUT. 1402, the change amount corresponding to nozzle number 15 is "−31" obtained by inverting the sign of the initial division ratio. The change amounts of the three nozzles with nozzle numbers 5, 25, and 35 are "31/3".

Reference numeral 1403 denotes the result obtained by convoluting the filter after correction with the LUT 1402.

Figure 15:
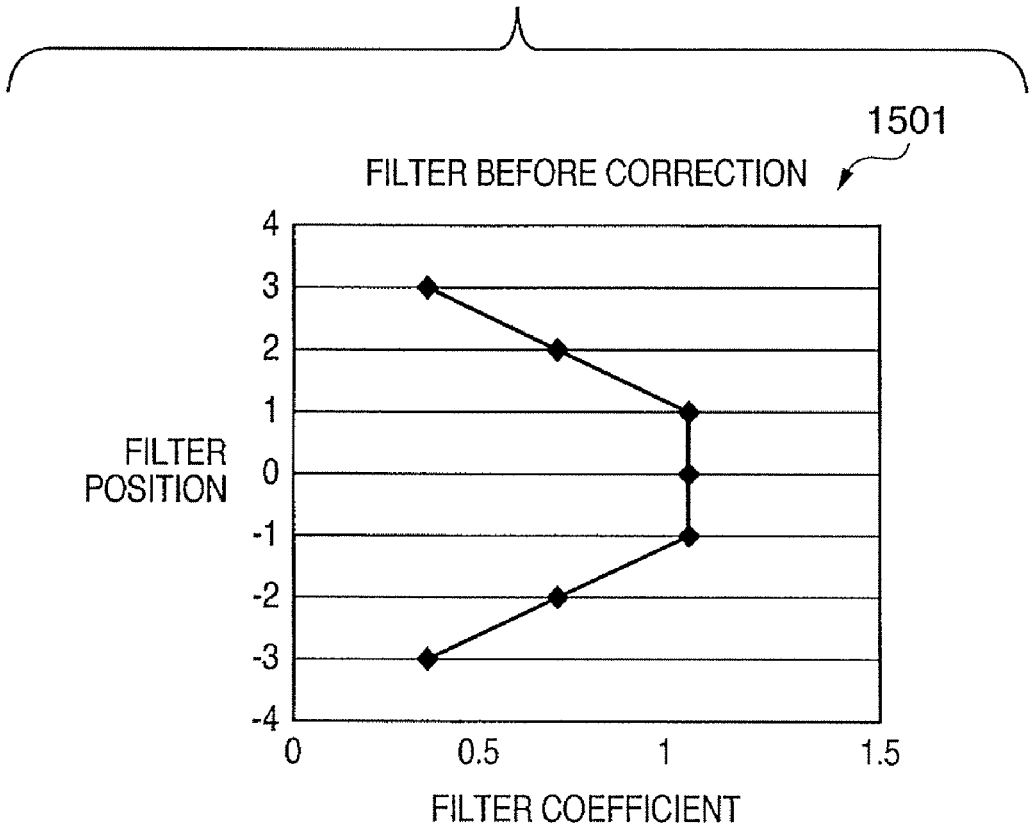
FIG. 15 is a graph showing an example of a filter used for the processing of changing the scan duty setting LUT in the second embodiment.
Figure 15:
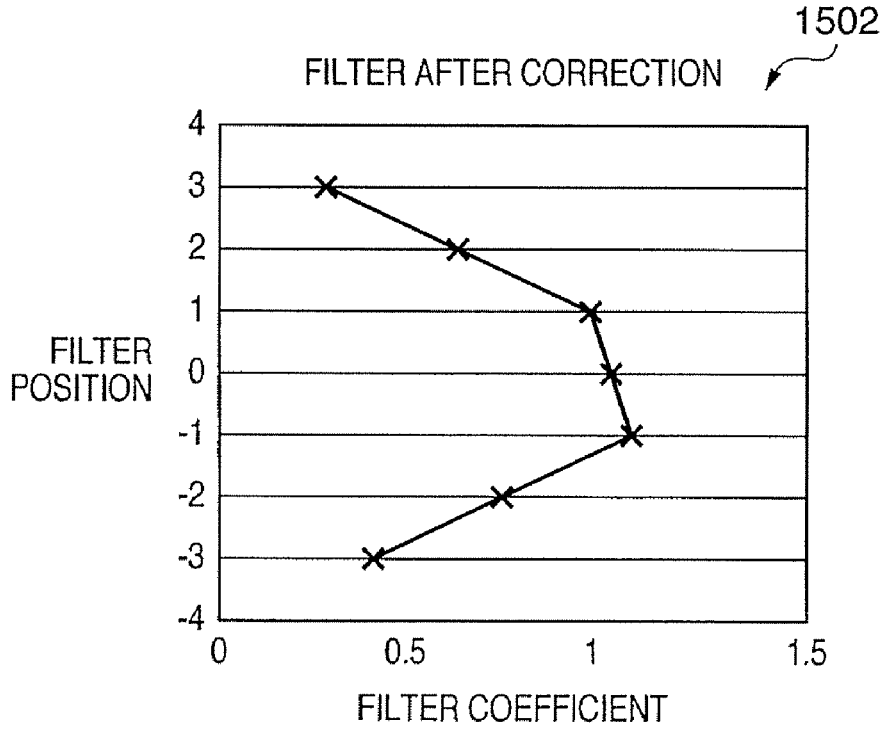

FIG. 15 shows the filter coefficients used in this case. Reference numeral 1501 in FIG. 15 denotes filter coefficients before correction, with the filter size being nine pixels. Reference numeral 1502 denotes the result obtained by correcting the coefficients 1501 in accordance with the initial division ratios of the neighboring nozzles of the faulty nozzle.

Reference numeral 1404 denotes the result obtained by adding the division ratio change LUT after filter convolution which is denoted by reference numeral 1403 to the initial scan duty setting LUT 105 denoted by reference numeral 1401. This is an output from the scan duty setting LUT changing unit 106 in the second embodiment, and is set as the scan duty setting LUT 107. That is, four-pass printing is performed by using the scan duty setting LUT 107 denoted by reference numeral 1404.

Reference numeral 1405 denotes an example of the scan duty setting LUT obtained by interpolating a faulty nozzle by using only corresponding nozzles. Obviously, this LUT is obtained by simpler interpolation than that performed for the LUT 1404, and hence is less robust against a sheet feeding error and the like.

As described above, the second embodiment can interpolate a duty which should be set for printing by a faulty nozzle and neighboring nozzles by using nozzles corresponding to the faulty nozzle and neighboring nozzles. This makes it possible to reproduce an input duty on all lines.

In addition, distributing the duty which should be set for printing by a faulty nozzle to not only corresponding nozzles but also neighboring nozzles will make not only the corresponding nozzles but also neighboring nozzles of the corresponding nozzles interpolate the faulty nozzle. This makes the neighboring nozzles of the corresponding nozzles perform interpolation and reduces the formation of white stripes even if the landing position of dots shift due to an error in the sheet feeding amount and the scanning positions of the nozzles corresponding to the faulty nozzle shift.

Third Embodiment

The third embodiment of the present invention will be described below. The third embodiment distributes the division ratio of a faulty nozzle to nozzles corresponding to the faulty nozzle and a plurality of neighboring nozzles of the corresponding nozzles by using a method different from that in the second embodiment. Note that the arrangement of an image forming system according to the third embodiment is the same as that shown in FIG. 12 according to the second embodiment, and hence a repetitive description will be omitted.

Figure 16:
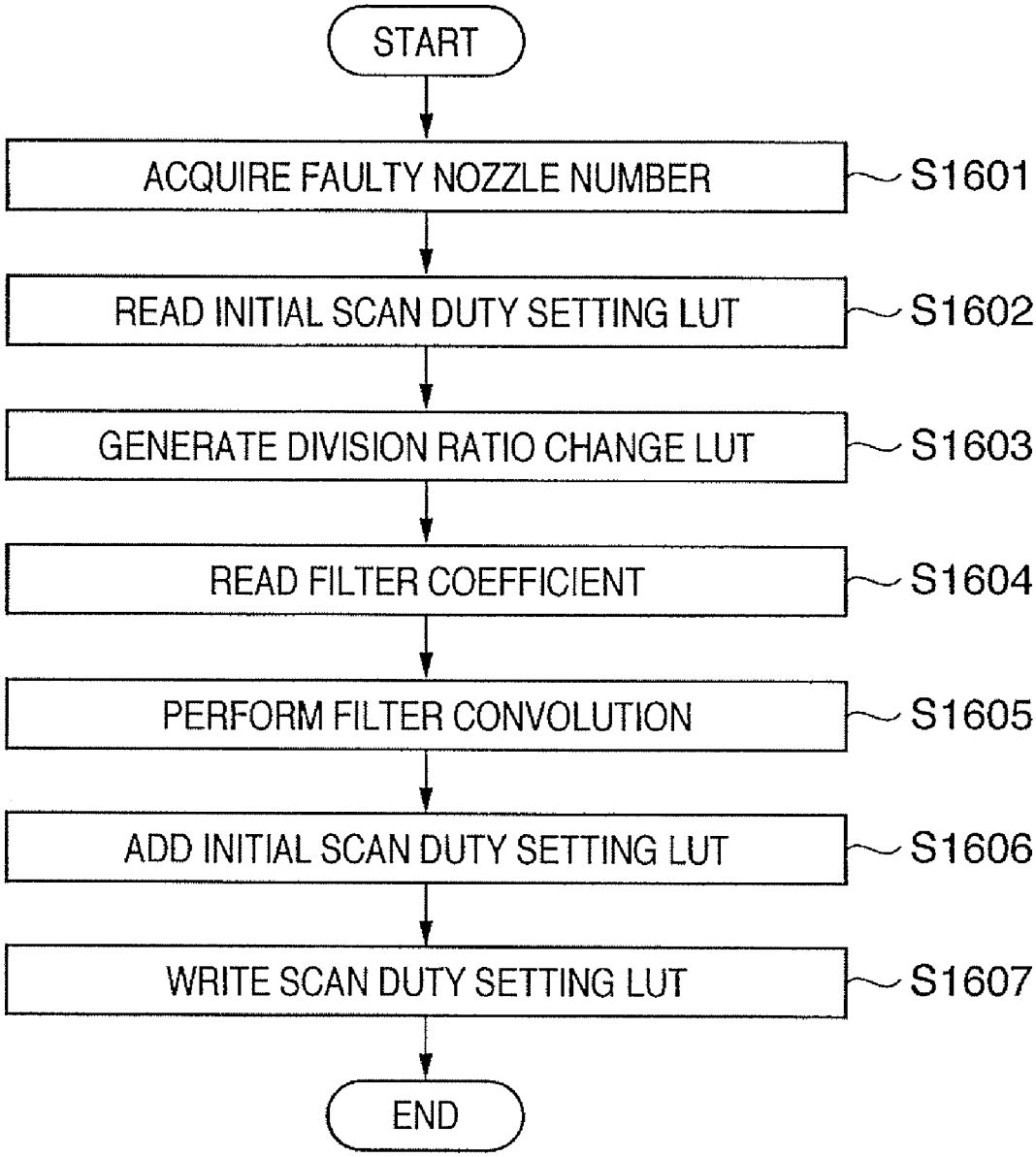
FIG. 16 is a flowchart showing the processing of changing a scan duty setting LUT in the third embodiment.

The operation of a scan duty setting LUT changing unit 106 in the third embodiment will be described in detail below with reference to the flowchart of FIG. 16.

First of all, the scan duty setting LUT changing unit 106 acquires the nozzle number of a faulty nozzle from a faulty nozzle information storage unit 209 (S1601), and reads out an initial scan duty setting LUT 105 (S1602).

The scan duty setting LUT changing unit 106 then determines nozzles to which the initial division ratio of the faulty nozzle is to be distributed, and generates a division ratio change LUT in which the change amounts of division ratios from the initial scan duty setting LUT 105 are recorded (S1603). In this stage, the scan duty setting LUT changing unit 106 distributes the initial division ratio of the faulty nozzle to nozzles corresponding to the faulty nozzle and neighboring nozzles of the faulty nozzle, and sets the distributed division ratios as change amounts. There is no need to distribute division ratios to all the nozzles corresponding to the faulty nozzle and the neighboring nozzles of the faulty nozzle. It suffices to distribute division ratios to only the corresponding nozzles. The scan duty setting LUT changing unit 106 can distribute the initial division ratio of the faulty nozzle to the respective distribution destination nozzles uniformly or in accordance with the initial division ratios of the distribution destination nozzles.

In the third embodiment, it is not necessary to match the sum of change amounts set for corresponding nozzles or nozzles neat a faulty nozzle with the initial division ratio of the faulty nozzle. That is, the third embodiment sets the sum of change amounts to a given value so as to reproduce the average density of an area after printing which is scanned by the faulty nozzle. This is because, even if total duties in a plurality of scans are equal, different duties corresponding to images printed in the respective scan may lead to different reproduced densities. More specifically, printing is performed with an input duty of 60%, the density reproduced by four scans each with a duty of 15% may differ from that reproduced by three scans each with a duty of 20%. For this reason, the third embodiment determines change amounts for distribution destinations so as to preserve the average density reproduced by printing instead of preserving a total duty.

As a method of determining change amounts for the reproduction of an average density after printing, there is available, for example, a method of generating a LUT by obtaining output densities corresponding to various total duties without any faulty nozzle and obtaining a total duty when there is a faulty nozzle for which a corresponding density is to be reproduced. This LUT generation method will be described. First of all, in a stage before the occurrence of a discharge failure, a tone level patch is printed by using the initial scan duty setting LUT 105, and the average density of the patch is measured in advance. When a discharge failure occurs, a plurality of scan duty setting LUTs are prepared by gradually changing the sum of division ratios of nozzles corresponding to the faulty nozzle and neighboring nozzles. A tone level patch similar to that printed without any faulty nozzle is printed by using each scan duty setting LUT, and the average density of the patch is measured. The total amount of division ratios for the neighboring nozzles which corresponds to a density nearest to the average density without any faulty nozzle is obtained for each tone level. Recording total amounts of division ratios for the neighboring nozzles for the respective tone levels in the form of a table will acquire a desired LUT. According to this LUT, each ink value data after color separation is input, and the sum of division ratios for corresponding nozzles and neighboring nozzles is output.

When a division ratio change LUT is generated in the above manner, the division ratios of neighboring nozzles of nozzles to which division ratios are distributed are changed. This change is performed by filter convolution as in the second embodiment. However, the method for this change is not limited to such a method using a filter.

First of all, filter coefficients stored in advance in a filter storage unit 1212 are read out (S1604). In this case, the filter size and filter coefficients can be arbitrary values. It is however preferable that the sum of filter coefficients become 1.

The division ratio change LUT generated in step S1603 is regarded as a one-dimensional digital signal value, and filter convolution is performed (S1605). If division ratios have been distributed to nozzles adjacent to the faulty nozzle, it is necessary to prevent any division ratio to the faulty nozzle by filter processing.

Finally, the division ratio change LUT after filter convolution, which is generated in step S1605, is added to the initial scan duty setting LUT 105 for each nozzle (S1606), and the resultant data is stored as a scan duty setting LUT 107 (S1607).

Figure 17:
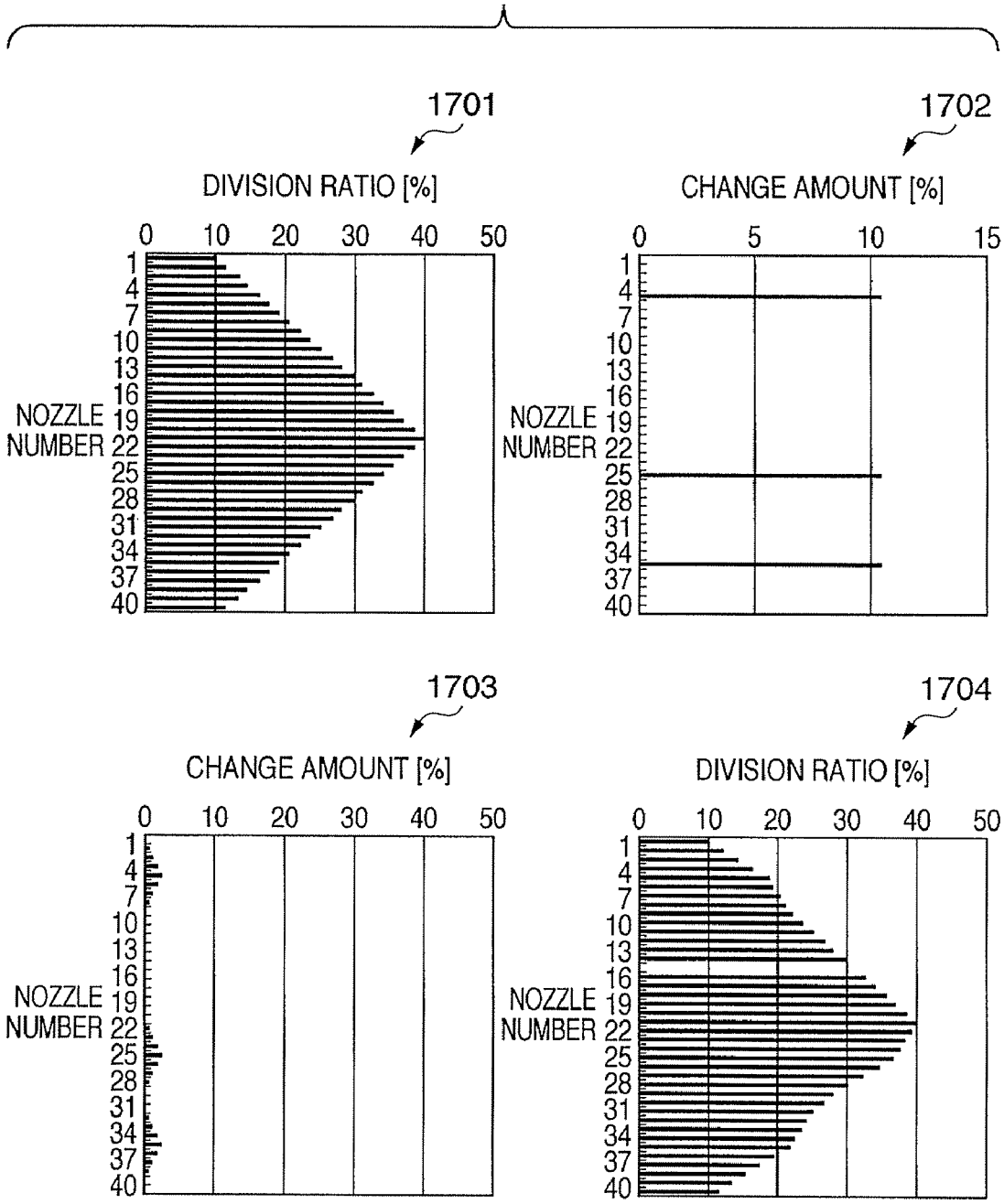
FIG. 17 is a view showing how the scan duty setting LUT is changed in the third embodiment.

The processing of changing a scan duty setting LUT in the third embodiment will be specifically described below. FIG. 17 shows an example of how a scan duty setting LUT is changed when the nozzle with nozzle number 15 is a faulty nozzle in four-pass printing with 40 nozzles. The following exemplifies a method of uniformly dividing the initial division ratio of the faulty nozzle for nozzles corresponding to the faulty nozzle. Note that the nozzles corresponding to nozzle number 15 of the faulty nozzle are three nozzles with nozzle numbers 5, 25, and 35.

Referring to FIG. 17, reference numeral 1701 denotes the initial scan duty setting LUT 105; and 1702, a division ratio change LUT obtained by uniformly distributing the initial division ratio of the faulty nozzle which is denoted by reference numeral 1701 to the three nozzles with nozzle numbers 5, 25, and 35. According to the LUT 1702, the initial division ratio corresponding to nozzle number 15 is distributed 1/3 by 1/3 to the three nozzles with nozzle numbers 5, 25, and 35.

Figure 18:
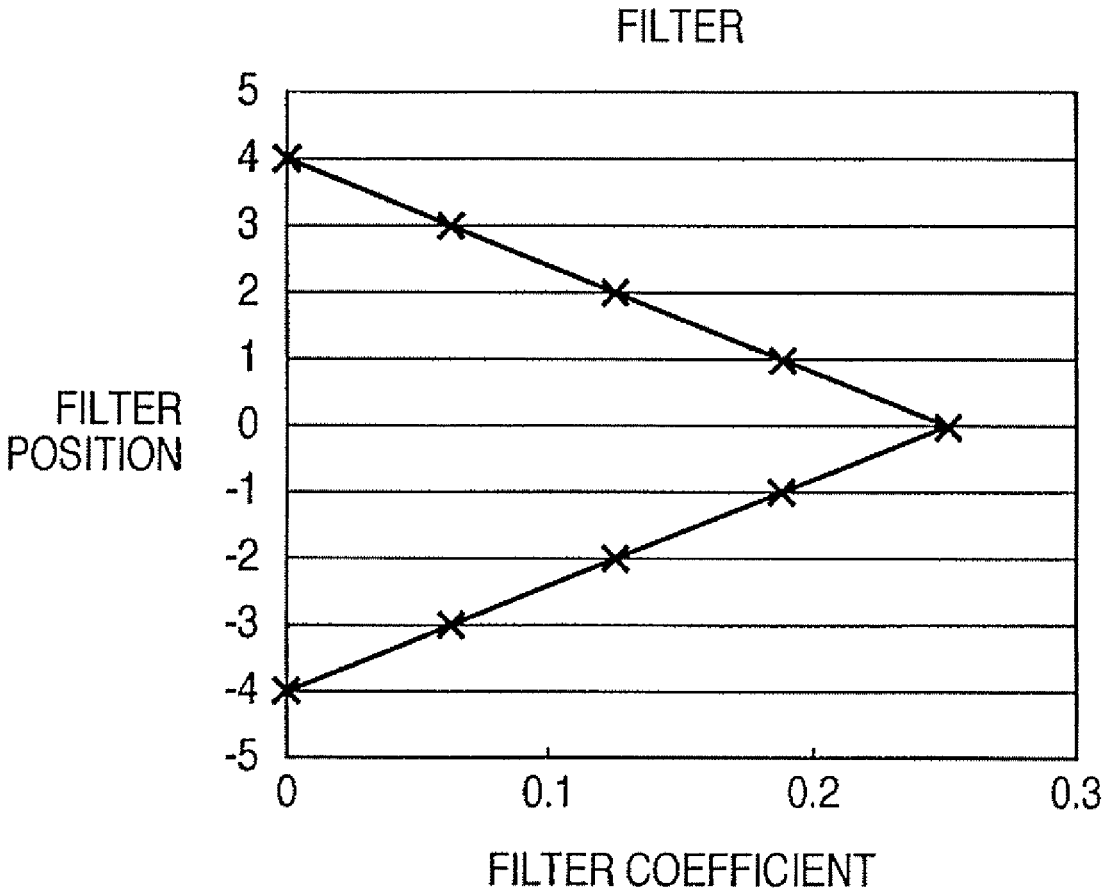
FIG. 18 is a graph showing an example of a filter used for the processing of changing the scan duty setting LUT in the third embodiment.

Reference numeral 1703 denotes the result obtained by convoluting a filter with the LUT 1702. FIG. 18 shows the filter coefficients used in this case.

Reference numeral 1704 denotes the result obtained by adding the division ratio change LUT after filter convolution, which is denoted by reference numeral 1703, to the initial scan duty setting LUT 105 denoted by reference numeral 1701. This data is output from the scan duty setting LUT changing unit 106 in the third embodiment, and is set as the scan duty setting LUT 107. That is, four-pass printing is performed by using the scan duty setting LUT 107 denoted by reference numeral 1704.

As described above, the third embodiment can interpolate a duty which should be set for printing by a faulty nozzle and neighboring nozzles by using the neighboring nozzles of the faulty nozzle and nozzles corresponding to the faulty nozzle and its neighboring nozzles.

In the third embodiment, however, when attention is paid to a line scanned by a faulty nozzle, a duty which should be set for printing by the faulty nozzle cannot be perfectly interpolated by nozzles corresponding to the faulty nozzle. However, when considering duties set for printing by neighboring nozzles of the faulty nozzle itself and neighboring nozzles of nozzles corresponding to the faulty nozzle as well, an input duty is reproduced on average.

Like the second embodiment described above, the third embodiment interpolates a duty which should be set for printing by a faulty nozzle by using not only corresponding nozzles but also neighboring nozzles. For this reason, even if the scanning positions of nozzles corresponding to a faulty nozzle shift due to a sheet feeding error or the like, interpolation is performed by neighboring nozzles of the corresponding nozzles, thereby reducing the formation of white stripes.

Other Embodiments

Each embodiment described above has exemplified the image processing apparatus using the inkjet printing method of forming an image by discharging ink onto a print medium by scanning the printhead having a plurality of nozzles arrayed in a predetermined direction on the print medium in a direction perpendicular to the nozzle array direction. However, the present invention can be applied to printing apparatuses which perform printing by methods other than the inkjet printing method (e.g., the thermal transfer method and the electrophotographic method). In this case, nozzles which discharge ink droplets correspond to printing elements or laser light-emitting elements which print dots.

In addition, the present invention can be applied to a so-called full-line printing apparatus which has a printhead with a length corresponding to the print width of a print medium and performs printing by moving the printhead relative to the print medium.

The present invention can take embodiments of a system, apparatus, method, program, storage medium (recording medium), and the like. More specifically, the present invention can be applied to a system comprising a plurality of devices (e.g., a host computer, interface device, image sensor, and web application) or an apparatus comprising a single device.

Note that the present invention can be applied to an apparatus comprising a single device or to system constituted by a plurality of devices.

Furthermore, the invention can be implemented by supplying a software program, which implements the functions of the foregoing embodiments, directly or indirectly to a system or apparatus, reading the supplied program code with a computer of the system or apparatus, and then executing the program code. In this case, so long as the system or apparatus has the functions of the program, the mode of implementation need not rely upon a program.

Accordingly, since the functions of the present invention can be implemented by a computer, the program code installed in the computer also implements the present invention. In other words, the claims of the present invention also cover a computer program for the purpose of implementing the functions of the present invention.

In this case, so long as the system or apparatus has the functions of the program, the program may be executed in any form, such as an object code, a program executed by an interpreter, or script data supplied to an operating system.

Example of storage media that can be used for supplying the program are a floppy disk, a hard disk, an optical disk, a magneto-optical disk, a CD-ROM, a CD-R, a CD-RW, a magnetic tape, a non-volatile type memory card, a ROM, and a DVD (DVD-ROM and a DVD-R).

As for the method of supplying the program, a client computer can be connected to a website on the Internet using a browser of the client computer, and the computer program of the present invention or an automatically-installable compressed file of the program can be downloaded to a recording medium such as a hard disk. Further, the program of the present invention can be supplied by dividing the program code constituting the program into a plurality of files and downloading the files from different websites. In other words, a WWW (World Wide Web) server that downloads, to multiple users, the program files that implement the functions of the present invention by computer is also covered by the claims of the present invention.

It is also possible to encrypt and store the program of the present invention on a storage medium such as a CD-ROM, distribute the storage medium to users, allow users who meet certain requirements to download decryption key information from a website via the Internet, and allow these users to decrypt the encrypted program by using the key information, whereby the program is installed in the user computer.

Besides the cases where the aforementioned functions according to the embodiments are implemented by executing the read program by computer, an operating system or the like running on the computer may perform all or a part of the actual processing so that the functions of the foregoing embodiments can be implemented by this processing.

Furthermore, after the program read from the storage medium is written to a function expansion board inserted into the computer or to a memory provided in a function expansion unit connected to the computer, a CPU or the like mounted on the function expansion board or function expansion unit performs all or a part of the actual processing so that the functions of the foregoing embodiments can be implemented by this processing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-029713, filed Feb. 8, 2007, which is hereby incorporated by reference herein in its entirety.

What is claimed is:

1. An image forming apparatus which forms an image by scanning a printhead having a plurality of printing elements on a print medium, the apparatus comprising:

an input unit configured to input image data;

a storage unit configured to store a table in which a printing amount division ratio for each of the printing elements is set for each main scan of the printhead;

a setting unit configured to set a printing amount for each of the printing elements for each main scan of the printhead in accordance with the image data based on the table;

an N-ary (where N is an integer not less than two) processing unit configured to generate a dot pattern as a formation target by performing N-ary processing for the printing amount set by said setting unit;

a detection unit configured to detect a faulty printing element, of the plurality of printing elements, which malfunctions; and an updating unit configured to update the table such that a printing amount which is to be distributed to the faulty printing element detected by said detection unit is distributed to another printing element which prints the same main scanning line as that printed by the faulty printing element.

2. The apparatus according to claim 1, wherein said updating unit updates the table such that a printing amount which is to be distributed to the faulty printing element is distributed to a plurality of other printing elements which print the same main scanning line as that printed by the faulty printing element.

3. The apparatus according to claim 2, wherein said updating unit updates the table such that a printing amount which is to be distributed to the faulty printing element is distributed to a plurality of other printing elements which print the same main scanning line as that printed by the faulty printing element, and neighboring printing elements of the plurality of other printing elements.

4. The apparatus according to claim 2, wherein said updating unit updates the table such that a printing amount which is to be distributed to the faulty printing element is distributed to first neighboring printing elements of the faulty printing element and a plurality of other printing elements which print the same main scanning line as that printed by the faulty other printing element, and second neighboring printing elements of the plurality of other printing elements.

5. The apparatus according to claim 1, wherein said updating unit updates the table such that a sum of printing amounts of the respective printing elements corresponding to the same area on the print medium coincides with a printing amount of the image data.

6. The apparatus according to claim 1, wherein said updating unit updates the table such that an output density based on the table becomes equal to an output density without the faulty printing element.

7. The apparatus according to claim 1, wherein the table holds information indicating a printing amount for each printing element in each scan.

8. A control method for an image forming apparatus which forms an image by scanning a printhead having a plurality of printing elements on a print medium, the method comprising the steps of:

inputting image data;

setting a printing amount for each of the printing elements for each main scan of the printhead in accordance with the image data based on a table in which a printing amount division ratio for each of the printing elements for each of the main scans is set;

generating a dot pattern as a formation target by performing N-ary processing (where N is an integer not less than two) for the printing amount set in the setting step;

detecting a faulty printing element, of the plurality of printing elements, which malfunctions; and updating the table such that a printing amount which is to be distributed to the faulty printing element detected in the detecting step is distributed to another printing element which prints the same main scanning line as that printed by the faulty printing element.

9. A non-transitory computer readable storage medium storing a program for performing the control method of claim 8.

10. An image processing apparatus for outputting a dot pattern to an image forming apparatus which forms an image by scanning a printhead having a plurality of printing elements on a print medium, the image processing apparatus comprising:

an input unit configured to input image data;

a storage unit configured to store a table in which a printing amount division ratio for each of the printing elements is set for each main scan of the printhead;

a setting unit configured to set a printing amount for each of the printing elements for each main scan of the printhead in accordance with the image data based on the table;

an N-ary (N is an integer not less than two) processing unit configured to generate a dot pattern as a formation target by performing N-ary processing for the printing amount set by said setting unit;

a detection unit configured to detect a faulty printing element, of the plurality of printing elements, which malfunctions; and an updating unit configured to update the table such that a printing amount which is to be distributed to the faulty printing element detected by said detection unit is distributed to another printing element which prints the same main scanning line as that printed by the faulty printing element.

11. A control method for an image processing apparatus for outputting a dot pattern to an image forming apparatus which forms an image by scanning a printhead having a plurality of printing elements on a print medium, the method comprising the steps of:

inputting image data;

setting a printing amount for each of the printing elements for each main scan of the printhead in accordance with the image data based on a table in which a printing amount division ratio for each of the printing elements for each of the main scans is set;

generating a dot pattern as a formation target by performing N-ary processing (where N is an integer not less than two) for the printing amount set in the setting step;

detecting a faulty printing element, of the plurality of printing elements, which malfunctions; and updating the table such that a printing amount which is to be distributed to the faulty printing element detected in the detecting step is distributed to another printing element which prints the same main scanning line as that printed by the faulty printing element.

12. A non-transitory computer readable storage medium storing a program for performing the control method of claim 11.

* * * * *